US005881591A

United States Patent [19]

Ondracek

[11] Patent Number: 5,881,591

[45] Date of Patent: Mar. 16, 1999

[54] AUTOMATIC CHANNEL LETTER BENDING MACHINE

[76] Inventor: Carl Ondracek, c/o Computerized Cutters, Inc., 1400 S. Sherman St., Suite 116, Richardson, Tex. 75081

[21] Appl. No.: 696,151

[22] Filed: Aug. 13, 1996

[51] Int. Cl.[6] ..... B21D 5/04; B21D 7/12; B21D 7/16

[52] U.S. Cl. ..... 72/14.9; 72/294; 72/307; 72/319

[58] Field of Search ..... 72/294, 307, 306, 72/319, 388, 14.9, 15.1

[56] References Cited

U.S. PATENT DOCUMENTS

| | | | |
|---|---|---|---|
| 1,155,479 | 10/1915 | Gray . | |
| 2,734,552 | 2/1956 | Yonash . | |
| 3,038,252 | 6/1962 | Turek . | |
| 3,270,541 | 9/1966 | Tishken . | |
| 3,344,633 | 10/1967 | Wilson . | |
| 3,546,975 | 12/1970 | Aijala . | |
| 3,581,535 | 6/1971 | Hinks | 72/307 |
| 3,584,660 | 6/1971 | Paine | 72/307 |
| 3,696,655 | 10/1972 | Hinks | 72/294 |
| 3,823,749 | 7/1974 | Ritter et al. | 72/307 |
| 3,879,979 | 4/1975 | Arai et al. | 72/306 |
| 3,986,470 | 10/1976 | Berry et al. | 72/331 |
| 4,049,026 | 9/1977 | Del Fabro | 72/307 |
| 4,535,665 | 8/1985 | Fazis | 83/556 |
| 4,562,754 | 1/1986 | Archer et al. | 72/307 |
| 4,696,211 | 9/1987 | Bitzel | 83/49 |
| 4,773,284 | 9/1988 | Archer et al. | 72/307 |
| 4,803,879 | 2/1989 | Crawford | 72/306 |
| 5,018,263 | 5/1991 | Stern | 72/307 |
| 5,105,640 | 4/1992 | Moore | 72/306 |
| 5,343,727 | 9/1994 | Osaka | 72/306 |
| 5,377,516 | 1/1995 | Lipari | 72/7 |
| 5,456,099 | 10/1995 | Lipari . | |
| 5,461,893 | 10/1995 | Tyler | 72/294 |
| 5,463,890 | 11/1995 | Tachibana | 72/294 |
| 5,495,741 | 3/1996 | Yamada | 72/387 |
| 5,507,168 | 4/1996 | Mizukawa | 72/307 |
| 5,787,750 | 8/1998 | Song | 72/319 |

FOREIGN PATENT DOCUMENTS 59-33032 A 2/1984 Japan .

OTHER PUBLICATIONS

Brochures from Logixx, Inc. Automation Systems, Circle Reader Service No. 141, Circle Reader Service No. 38, Circle Reader Service No. 45 (Dates of Publication unclear), 3 pages.

*Primary Examiner*—Daniel C. Crane
*Attorney, Agent, or Firm*—Wenderoth, Lind & Ponack, L.L.P.

[57] ABSTRACT

In a machine for automatically bending a material into the outside skin of a channel letter, a desired configuration of the channel letter is input into a control computer. The computer controls the feed of the strip of metal into the machine for the bending of the metal into the outside skin. Feed assemblies feed the material along a material feed path of the machine. A notching station notches the edge of the material where necessary for purposes of forming flanges in the material and bending the material. A subsequent flange forming station forms the flanges on the edge of the material, when desired. A bending assembly bends the strip of material into the desired form, with the bending arm moving from one side to the other of the material as necessary. The material is cut at a cutting station immediately preceding the bending assembly when the length of the material needed for the formation of the outside skin has been fed to the appropriate point at the cutting station along the material feed path.

24 Claims, 22 Drawing Sheets

AUTOMATIC CHANNEL LETTER BENDING MACHINE

BACKGROUND OF THE INVENTION

1. Field of the Invention

The present invention relates to a machine for bending metal to form the outside skins of channel letters. More particularly, the present invention relates to a machine that can automatically bend metal material into the form of outside skins of channel letters for signs, primarily exterior signs.

2. State of the Prior Art

At most shopping strip malls, restaurants and other stores, the main electrically illuminated sign which is out front, typically displaying the name of the business, will be made of channel letters. Each channel letter is composed of a front face that is usually made of plastic, and can be any of various colors. The front face forms the letter seen by the public in viewing the sign. Each channel letter also has a back, which is commonly made of aluminum. The front face and back can be cut manually or by using computer controlled routers. Between the front and the back, however, there is an outside skin, usually made of metal, connecting the front face and the back.

The outside skin is usually made of metal. The outside skin has to be formed into the shape of the letter matches the same shape of the cut out front face and back. To date, all of the metal outside skins of channel letters are manually bent. This is a very labor intensive job, and for this reason channel letters make up the highest dollar segment of the multi-billion dollar sign industry.

Various apparatus are known in the prior art for bending sheet or sheet-like material. U.S. Pat. No. 5,461,893 discloses a method and apparatus for bending steel rule in which a coil of steel rule material is unwound and fed to a notcher/cutter that cuts notches in the rule at selected locations prior to bending. The rule is then bent by a clamping device holding the rule and a bending tool rotating to bend the rule. The bending tool can be positioned on either side of the rule for making bends in opposite directions. U.S. Pat. Nos. 4,773,284 and 3,823,749 provide bending devices that are similar in operation.

U.S. Pat. Nos. 5,463,890, 5,507,168 and 5,495,741 each disclose a bending mechanism that operates slightly differently from that above. In each of these patents, a strip of material is passed through a clamping or holding portion, and a bending portion can be relatively rotated in either rotary direction to cause the bend of the material to occur.

U.S. Pat. Nos. 3,879,979, 3,986,470, 3,038,252, 3,270,541 and 3,581,535 disclose various methods of bending metal materials also including in some instances the formation of notches in the material.

However, none of the above-disclosed apparatus and methods for bending metal materials are suitable for forming the outside skins of channel letters. In particular, none of these devices can automatically form a channel letter.

SUMMARY OF THE INVENTION

In view of the above-described deficiencies of the prior art recognized by the present inventors, it is a primary object of the present invention to provide a channel bending machine that is capable of automatically forming the outside skins of channel letters. It is a corresponding object of the invention to provide a machine and a method of operating such a machine that avoids the necessity of intensive manual labor for bending the outside skins of channel letters so as to save labor costs in the manufacture of signs.

According to the invention, there is provided a channel bending machine that has a supply of material to be bent. A number of material feeding mechanisms are disposed along the path of travel of the material to be bent so as to feed the material along the path of travel. A notching station is disposed along the path of travel so as to notch the material supplied from the supply. A flange forming assembly is disposed along the path of travel for forming a flange between notches formed at the notching station along one edge of the material. A cutting station is disposed downstream of the flange forming assembly for cutting the material. A bending station bends the material into the appropriate letter shape for the outside skin.

The supply of material comprises a roll of metal material which is positioned on a motorized rotary table adjacent to one of the plurality of material feeding mechanisms. All of the material feeding mechanisms has a driven roller that is positioned on one side of the path of travel, with the driven roller being connected to a motor for rotation thereof. A press roller is disposed on the other side of the path of travel, the press roller being mounted for pressing movement toward the driven roller so as to be able to hold the material against the driven roller such that the driven roller can feed the material. Preferably, the press roller is movably mounted on linear bearings for linear movement toward and away from the driven roller. Fluid cylinders or motors having rods thereof connected with the press roller move the press roller toward or away from the driven roller.

The notching station preferably comprises a punch located on one side of the path of travel and a die located on the other side of the path of travel. The notching station further comprises a fluid cylinder that is connected with the punch for driving the punch toward the die. The punch and die extend over a predetermined angular range, and are rotatably mounted for synchronous rotation. The notching station has a motor with an output shaft connected with the die and the punch by pulleys rotatably connected to the die and the punch.

The flange forming station preferably comprises material support members that are located on opposite sides of the path of travel of the material. A pressing member is movably mounted adjacent to the supports members, with the pressing member having a pressing surface for pressing the material and bending a flange thereon. A fluid cylinder or motor is connected with the pressing member for moving the pressing member into engagement with the material. Preferably the pressing member is mounted on a linear bearing for linear movement toward one end of the support member. The motor is preferably a fluid motor that has a rod connected with the pressing member. The support members have a lower surface, and the pressing member is mounted below the lower surface for movement toward the lower surface for bending the flange on the material against the lower surface.

The cutting station comprises a knife that is movably mounted for movement across the path of travel of the material. A pair of support members are located on opposite sides of the path of travel of the material and have a slit therebetween for receiving the material therethrough. The knife is mounted on one side of the support members adjacent to the slit. The fluid cylinder or motor is connected to the knife for linear movement of the knife across the slit for cutting the material.

The bending station includes a fixed support that is positioned adjacent to the path of travel of the strip of material, a clamping support that can move perpendicular to the material and a movable bending arm that is movable across the path of travel of the material so as to bend the material against either the fixed support or the clamping support.

The movable bending arm is mounted on two rotatable bases for movement across the path of travel of the material. A lower one of the rotatable bases is rotatably mounted on a platform below the material to be bent. The platform is movable in a direction of the axis of the rotation of the rotatable base. The bending arm can rotate from one side of the material at the bending station to the other side of the material. The bending arm is fixed at one end thereof to the lower rotatable base, and is removably engaged at an opposite end thereof with a rotatable upper support. The rotatable upper support, or upper rotatable base, is rotatably mounted on a fixed platform located above the material to be bent. The rotatable upper support is preferably synchronously rotated with the lower rotatable base. A first engagement mechanism on the rotatable upper support engages the opposite (upper) end of the bending arm, and the opposite (upper) end of the bending arm comprises a second engagement mechanism for engaging the first engagement mechanism. One of these first and second engagement mechanisms is a pair of pins, while the other comprises pin receiving holes.

At least one fluid cylinder or motor is connected with the platform for movement thereof.

Furthermore, a movable support is preferably positioned on a side of the path of travel opposite to the side of the path of travel at which the fixable support is located. At least one fluid cylinder or motor is connected with the movable support for movement of the movable support toward and away from the fixable support.

The bending mechanism preferably includes a frame for mounting the various components thereof. Guide mechanisms are mounted on the frame for guiding the material to be bent along the material feed path at the bending station. The movable platform is preferably movable between a first position in which the bending arm is adjacent to the material feed path and a second position in which the bending arm is remote from the material feed path. The bending arm can thus be moved between the one and the other position thereof of the movable base when the movable platform is in the second position without interfering with any material that is being bent at the bending station.

The bending arm, fixed to one movable or rotatable base, and connectable with another movable or rotatable base, is rotatably driven by respective first and second motors connected with these respective bases when in position for bending. These motors are synchronously rotated at all times.

With the above-described apparatus, a metal material can automatically be bent into a described configuration or shape corresponding to an outside skin of a channel letter. The desired configuration of an outside skin of a channel letter is input into a control computer. This may comprise one or more pieces that total the whole letter. The computer controls the feed of a strip of the metal material from the supply of the metal material to the notching station. The strip of material is fed from the notching station to the flange forming station, subsequently, and then is further fed from the flange forming station to the cutting station. The strip of material is cut at the cutting station when appropriate, i.e. when the last section of material necessary for the outside skin of the letter being formed has been fed to the cutting station. The strip of material is bent at the bending station into the desired configuration for the outside skin, with the bending station being controlled by the control computer.

The notching station notches the strip of material where appropriate. More specifically, when a flange is formed on the material, it will be necessary to notch the material at positions where the material is to be bent (flanged) so as to be able to properly bend the material.

The step of notching comprises forming the notch along an edge of the strip of material with the computer controlling the punch and die of the notching station to punch the notch along the edge of the material. The wedge shaped punch is driven by the fluid cylinder or motor toward the female matched wedge shaped die with the strip of metal material therebetween. Thus a wedge-shaped notch is formed at the edge of the material.

When notching the material at bending locations where the wedge-shaped notch is to have a final notch angle greater than the angle of the wedge-shaped die, the steps of notching include rotating the punch and die to an angular position equal to (desired notch angle minus the angle of wedge shaped die) divided by two, driving the punch toward the die and retracting, rotating the die and punch in the opposite direction equal to the desired notch angle, and driving the punch toward the die a second time. Furthermore, in the step of bending, the notches in the material aid the bending when a change is present so that the correct shape can be bent into the material The step of forming the flange on the strip of material at the flange forming station includes supporting the strip of material and pressing an edge of the strip of material such that it bends to form a 90° angle with the remainder of the strip of material. Flanges are formed between respective notches notched into the edge of the material. Furthermore, in the step of bending, the material is bent at each notch that is formed by the notch forming station.

By repeating the above steps, the outside skin of a channel letter can be automatically formed to whatever desired letter or character configuration by simply notching and flanging the material where appropriate and bending to the appropriate degree at each point where the material needs to be bent to form the selected character. This process can be entirely controlled by the control computer. Accordingly, the present invention avoids the necessity of manual bending of a strip of material.

BRIEF DESCRIPTION OF THE DRAWINGS

Further objects, features and advantages of the present invention will become apparent from the following detailed description of a preferred embodiment thereof taken with reference to the accompanying drawings, in which.

DETAILED DESCRIPTION OF THE PREFERRED EMBODIMENT

As discussed in the background of the invention, in the sign industry it is required to form the outside skins of so-called channel letters. The strips of material that are provided for the channel letters are usually 5.2 inches high and 0.050 inches wide. The bending machine as initially illustrated in FIG. 1, according to the present invention, can bend this strip of material into the desired input shape to form the outside skin of a channel letter.

In some cases of forming the channel letter, the bottom one-half inch of the material will need to be bent in order to form a flange to which the aluminum back of the channel letter will be attached. When a flange is required on a channel letter, the flange must be notched wherever it is to be bent. If at a certain point the material needs to be bent 60°, for example, the notch at this point would need to be cut to 60°. The machine according to the present invention can take a supply of material, typically aluminum strip material, notch it appropriately, bend a flange if required, bend the material into the appropriate shape for the channel letter, and cut the material to the appropriate size.

Figure 1:
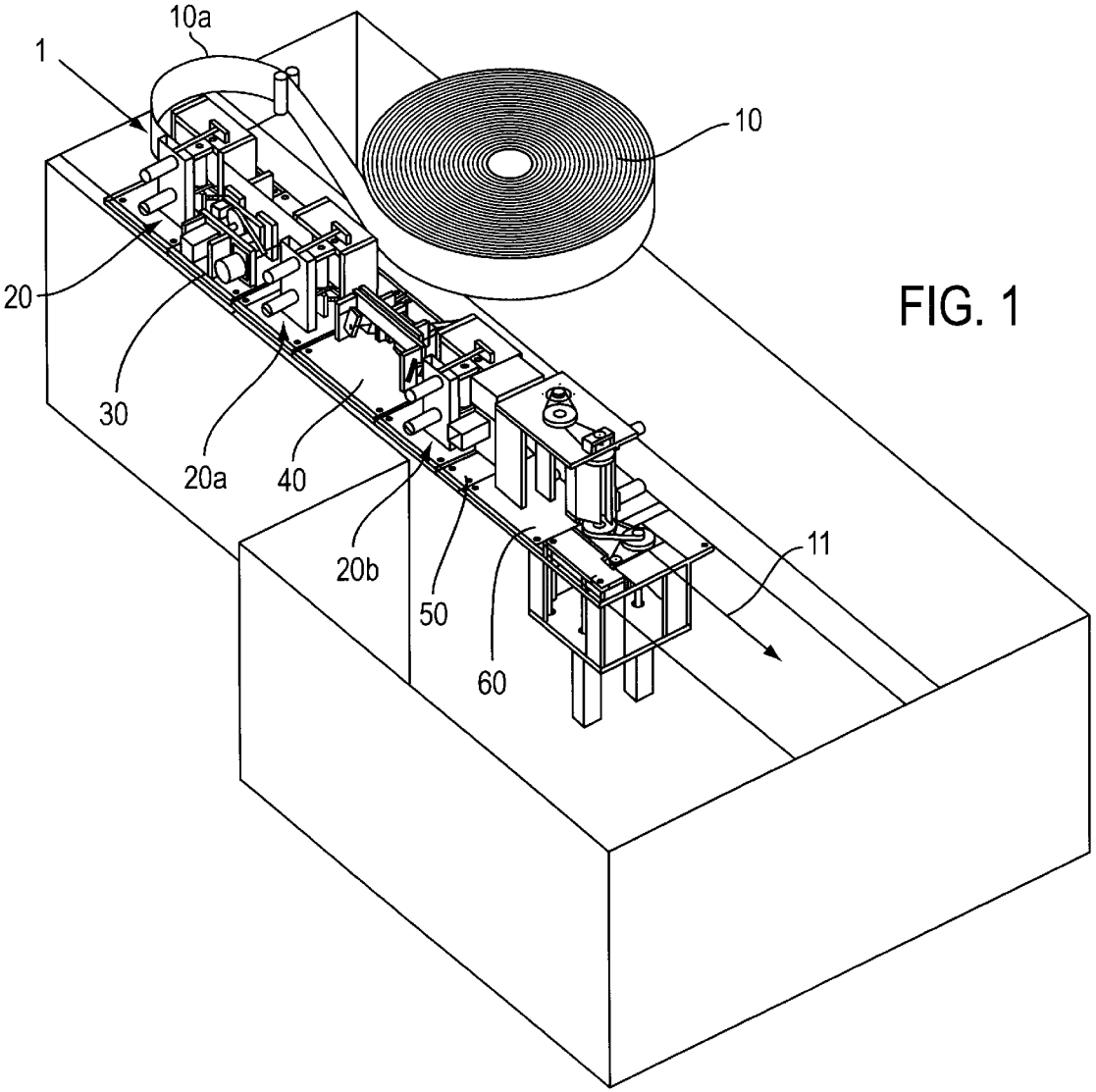
FIG. 1 is a perspective view of an automatic channel letter bending machine according to the present invention.

The overall machine can be seen in FIG. 1. In this figure, a roll of material 10 is rotatably mounted on the machine for supplying strips of material to be bent. Typically the material comes in a roll, but it can also be supplied to the machine in strips of material.

Ordinarily the roll of material will be placed on the machine on a rotating table. The rotating table is turned by a suitable motor that is synchronized with the feed motors pulling the material through the machine. A strip of material boa travels through the machine along a material feed path 11 that is defined by the various material handling stations on the machine.

Figure 2:
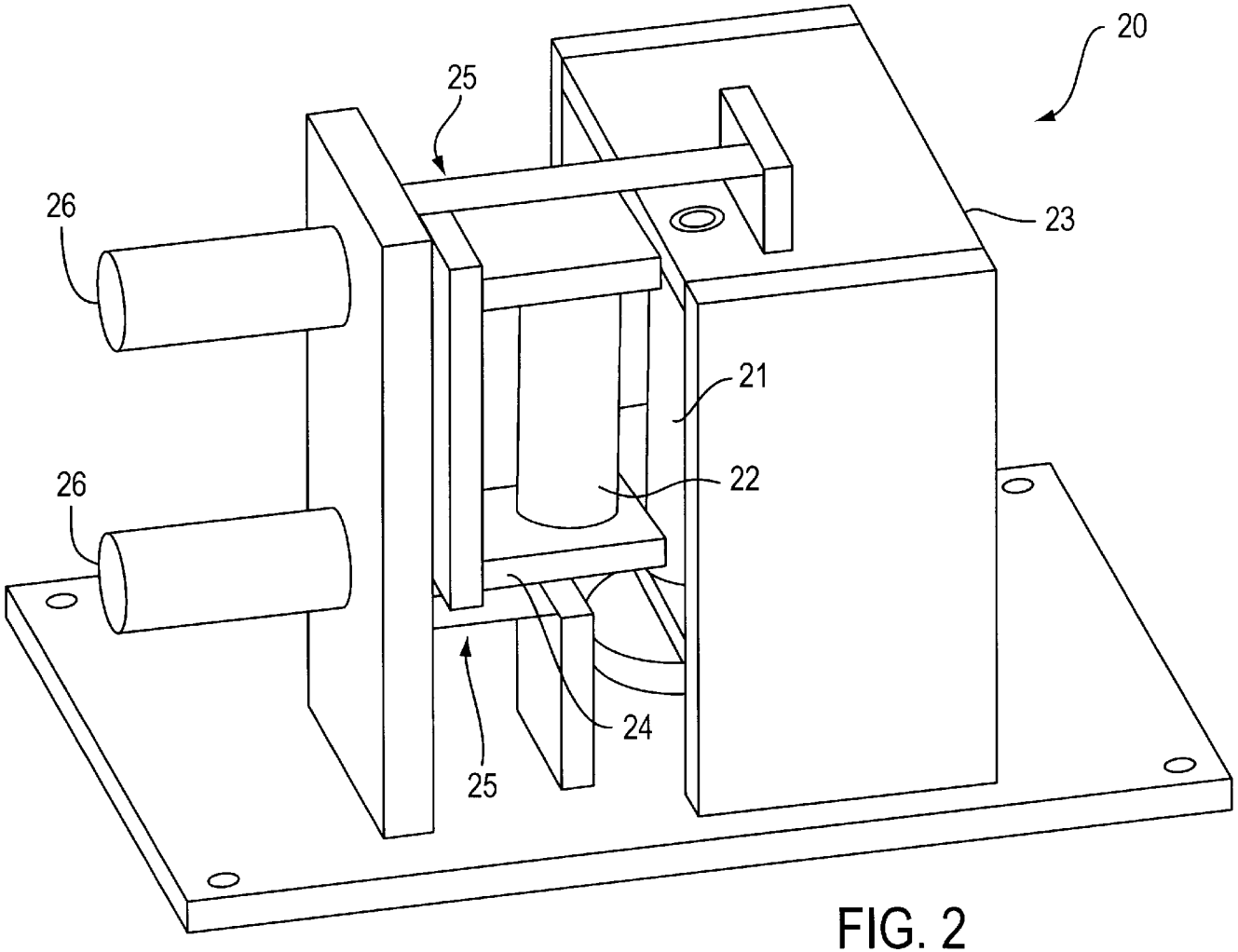
FIG. 2 is a schematic perspective view of a feed assembly of the machine of FIG. 1.
Figure 3:
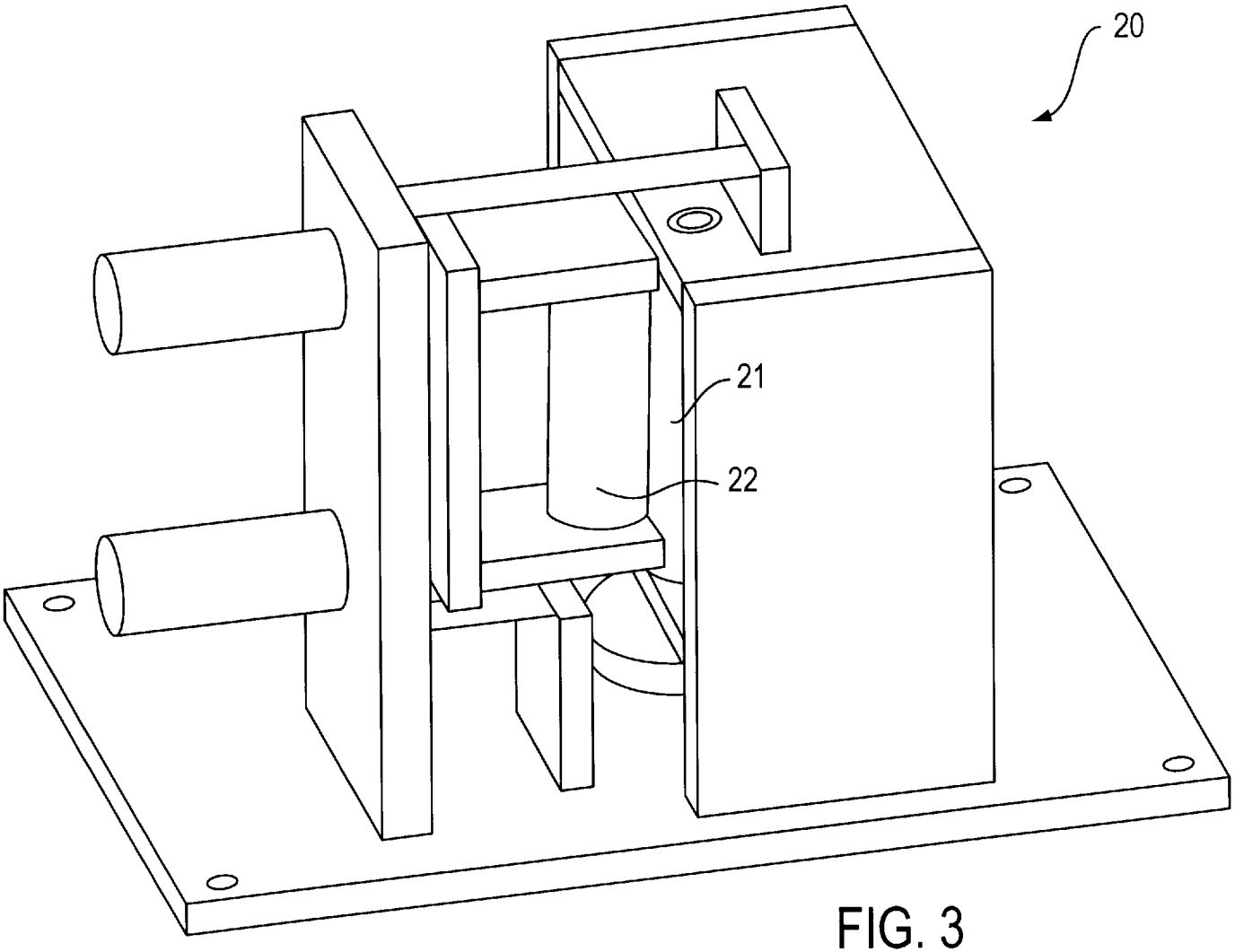
FIG. 3 illustrates the feed assembly of FIG. 2 in an operative position.

The material must be loaded into the machine by pushing the material past a first set of rollers at the feed assembly 20 when initially loading the material. Referring to FIG. 2, the feed assembly includes a driven roller 21 operated by a suitable motor and a press roller 22. The press roller 22 is mounted on a press roller housing 24 for movement toward and away from the driven roller 21. When material is to be advanced by the feed assembly 20, the press roller housing 24 is driven by fluid cylinders, or motors 26, which are engaged with the press roller housing 24, toward the driven roller 21 such that the press roller 22 and driven roller 21 sandwich the material therebetween. The press roller 22 thus forces the material against the driven roller 21, and by operating the driven roller 21 with the motor the material is advanced.

The driven roller 21 is mounted in a suitable driven roller housing 23. Linear bearings 25 are provided for supporting the press roller housing 24 in linear movement toward and away from the driven roller 21.

The driven roller 21 is driven by a suitable stepper/servo motor. An exact linear distance of the material can be fed through the machine by suitable control of the motor.

Two additional feed assemblies 20*a* and 20*b* are provided along the material feed path 11 of the machine, as illustrated in FIG. 1. These feed assemblies are preferably the same as the feed assembly 20, and thus no further description of their components is necessary or provided.

The material is fed along the machine until it triggers a switch in front of a notching assembly 30, illustrated schematically in FIG. 1. After the switch has been triggered, the strip of material 10*a* is fed in an exact amount to a precise starting point for the part to be formed, and a linear counter is zeroed.

Figure 4:
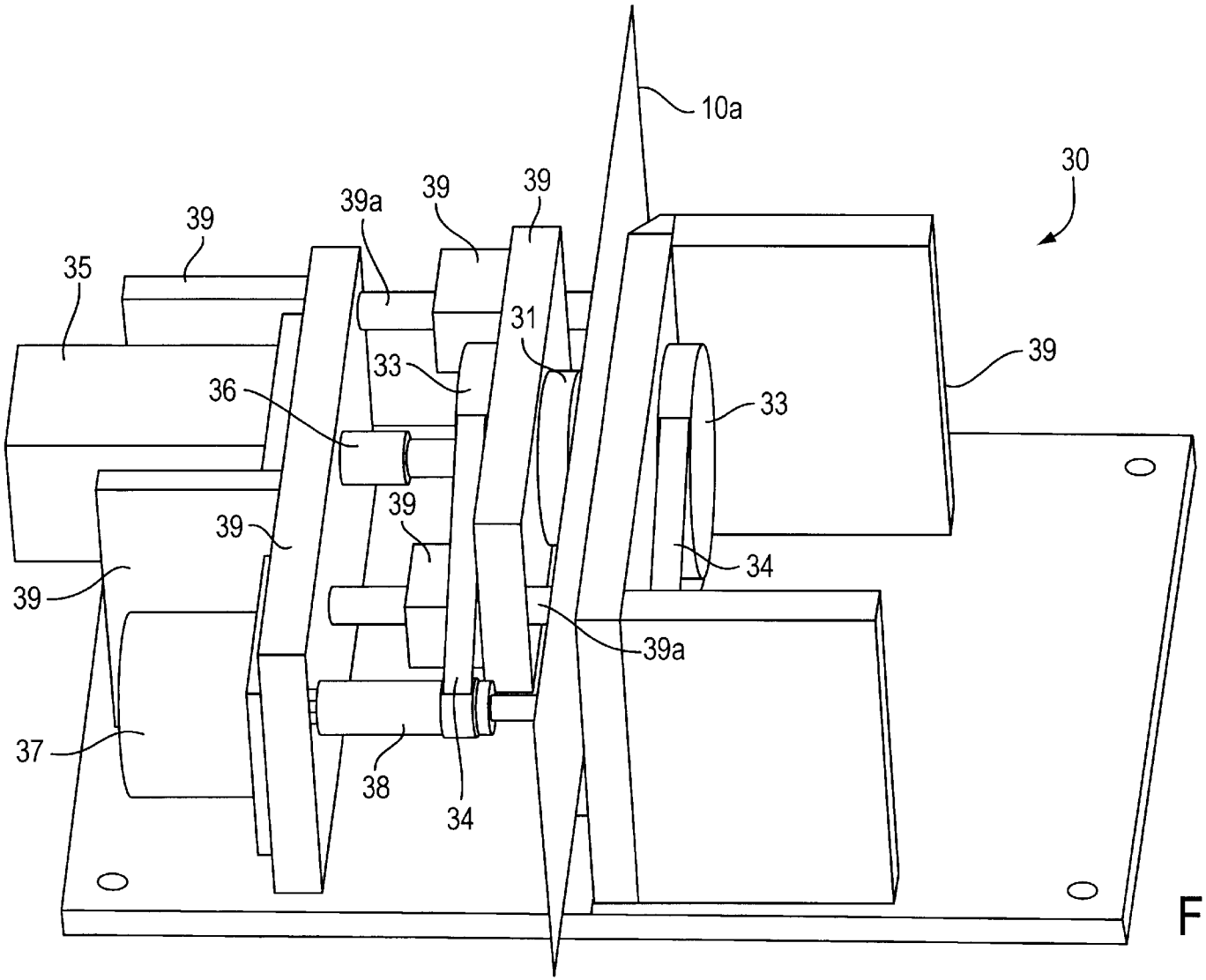
FIG. 4 is a schematic and perspective view of a notching assembly of the machine of FIG. 1.
Figure 5:
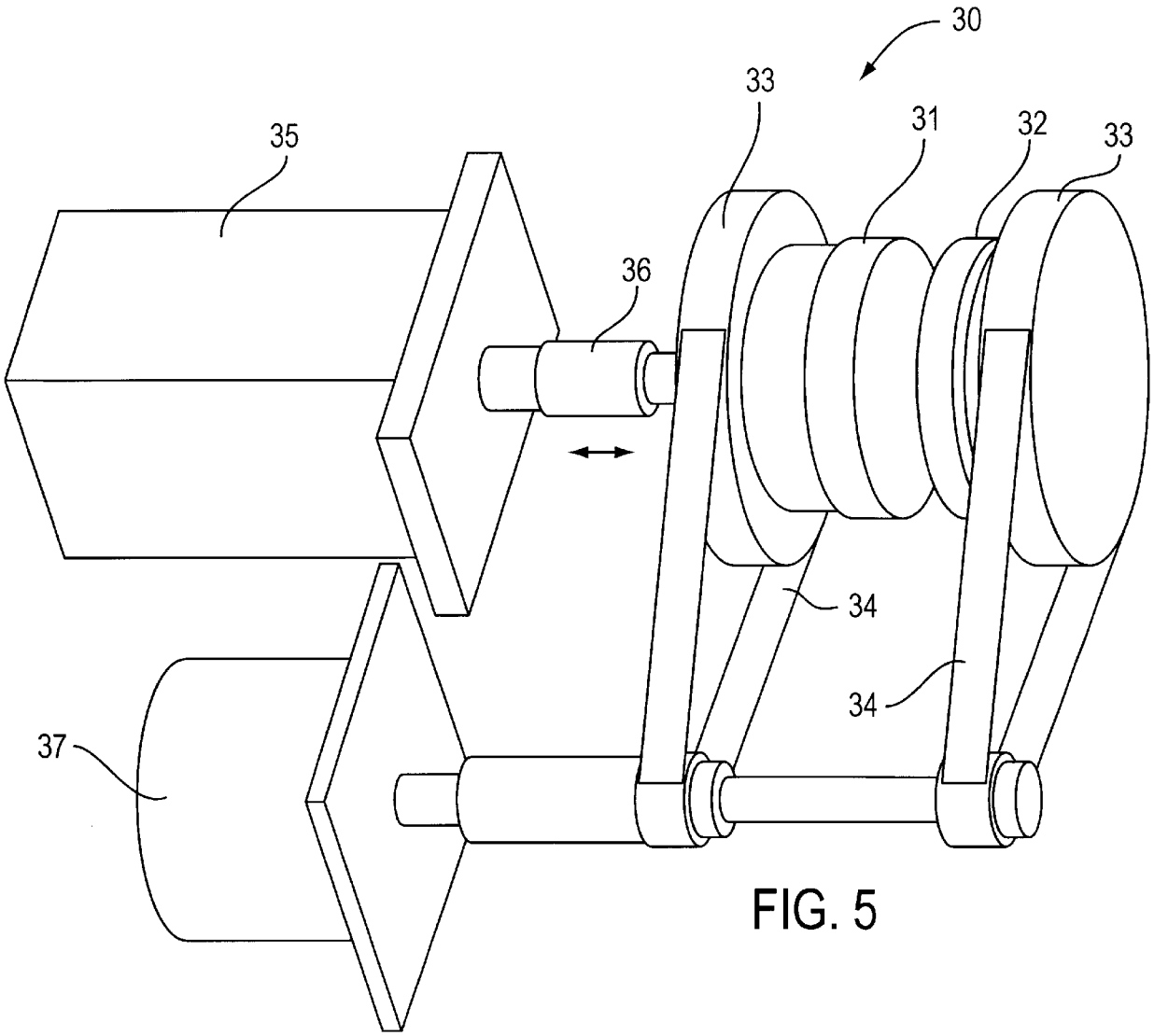
FIG. 5 is a schematic perspective view of salient parts of the notching assembly of FIG. 4.
Figure 6:
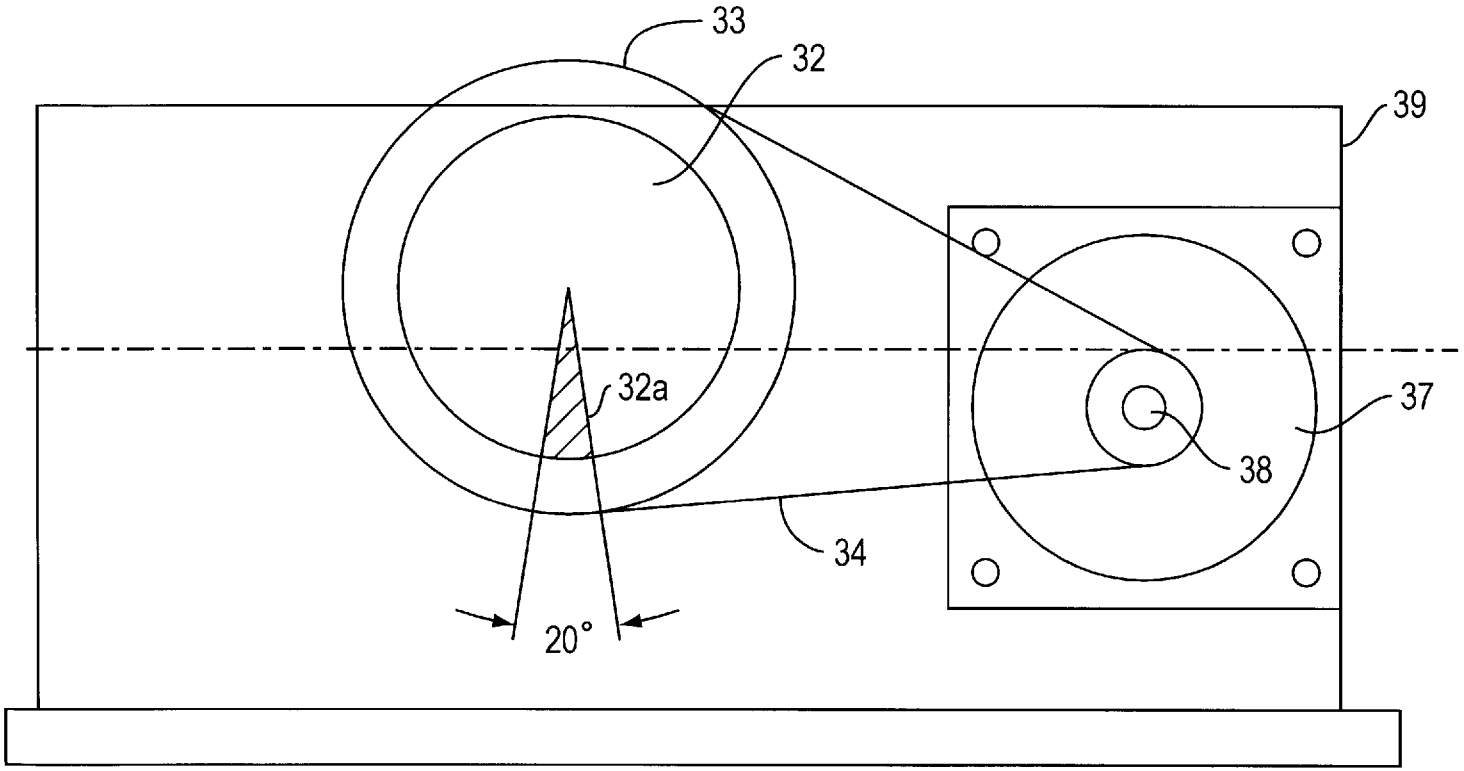
FIG. 6 is an illustration of an angled die of the notching assembly of FIG. 4.

Referring to FIG. 4, the strip of material 10*a* is fed by the first feed assembly 20 to the notching assembly 30 along the material feed path 11 so as to align a portion of the material 10*a* for notching. Referring to FIGS. 4–6, the notching assembly includes a punch 31 and a die 32. These are mounted on respective pulleys 33 so as to be capable of rotatable movement. A motor 37 is mounted on a support 39 which is in turn mounted on or supported by a frame or base of the machine as a whole. The motor 37 has a shaft 38 that drives a suitable belt 34 for each pulley 33. Thus, as can be seen from FIG. 5 in particular, when the motor is driven, both the punch 31 and the die 32 are synchronously rotated.

The die 32 has a die sector 32a thereon, as can be seen from FIG. 6. A corresponding punch sector is formed on the punch 31. Preferably, this sector extends over an angle of 20°. Thus, due to the synchronous rotation of the punch 31 and the die 32, the punch sector and the die sector 32*a* will always be maintained across from each other. Thus, the punch and die can be rotated to different angular positions for punching a notch in the strip of material at different locations.

To punch the material, a fluid cylinder, or motor, 35 drives its shaft 36 in the direction of the die 32. The punch 31 and its pulley 33 are fixed with respect to the shaft 36, and thus are moved in the direction of the die 32 to punch the notch in the strip of material 10*a*. As the range of movement of the punch 31 is relatively small, it is not necessary for the shaft 38 of the motor 37 to similarly move in the direction toward the die 32, because there is sufficient play with the belt 34 to allow for the punching movement. However, different arrangements for this portion of the notching assembly 30 can obviously be considered. For example, the pulley 33 could be axially fixed with respect to the shaft 36, with a slidable gear or spline connection between the die 31 and an interior circumferential portion of the pulley 33.

It is noted that reference No. 39 in FIGS. 4–6 refers to various different support members for supporting the components of the notching assembly 30. Reference No. 39*a* refers to support shafts, which can also form linear bearings for movement of appropriate support members thereon during punching. See in particular FIG. 4.

As discussed above, a notch is formed along the edge of the material at places corresponding to a position of bending when the strip of material 10*a* is to have a flange. The notch thus allows the material to be bent, even with a 90° flange thereon, without buckling. When the control program calls for a notch to be placed in the material, if the angle to be bent at this point is less than or equal to 20°, the program commands the fluid cylinder or motor attached to the notch assembly to fire and retract once. This causes a pie-shaped slice to be cut from the material to form the notch. If the angle which is to be bent is greater than 20°, then the punch and die will rotate positively an amount equal to one-half of (the bending angle minus 20°), and then cause the hydraulic cylinder attached to the notch assembly to fire and retract. The punch and die then both rotate to a negative position that is equal to one-half of (the bending angle minus 20°). The fluid cylinder or motor then proceeds to further fire and retract.

Thus, a correctly angled pie-shaped slice is cut from the material.

After the material has been notched at the notching assembly 30, the feed assembly 20*a* is operated, as necessary in conjunction with the other feed assemblies, to forward the material to the flange forming assembly 40. The flange forming assembly 40 can be seen in FIGS. 7–9.

As discussed above, the material 10*a* being fed through the machine may need to have a flange formed along one edge. The flange forming assembly 40 forms this flange along the lower edge of the strip of material 10*a* moving through the machine of the present invention.

Figure 7:
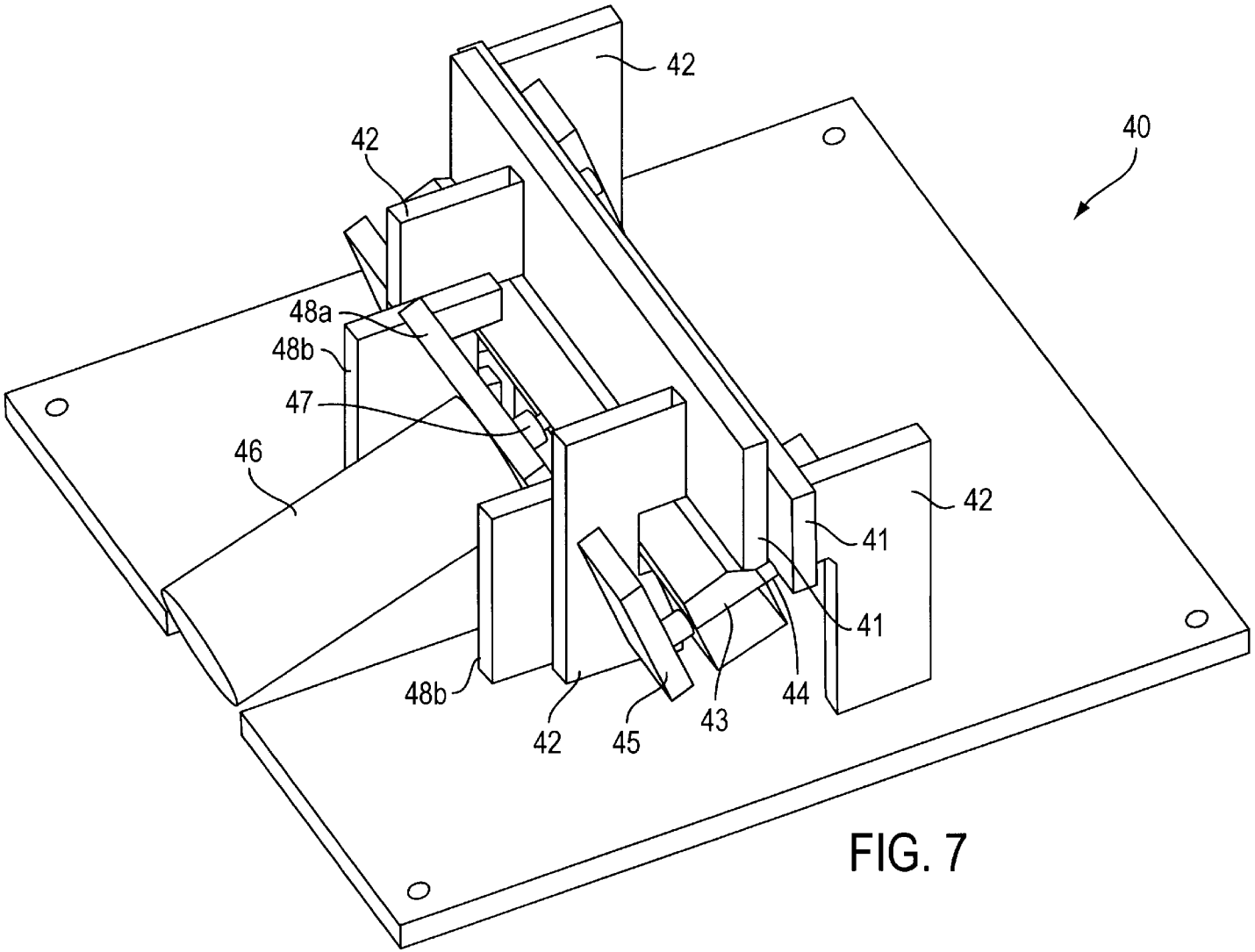
FIG. 7 is a schematic perspective view of a flange forming assembly of the machine of FIG. 1.
Figure 8:
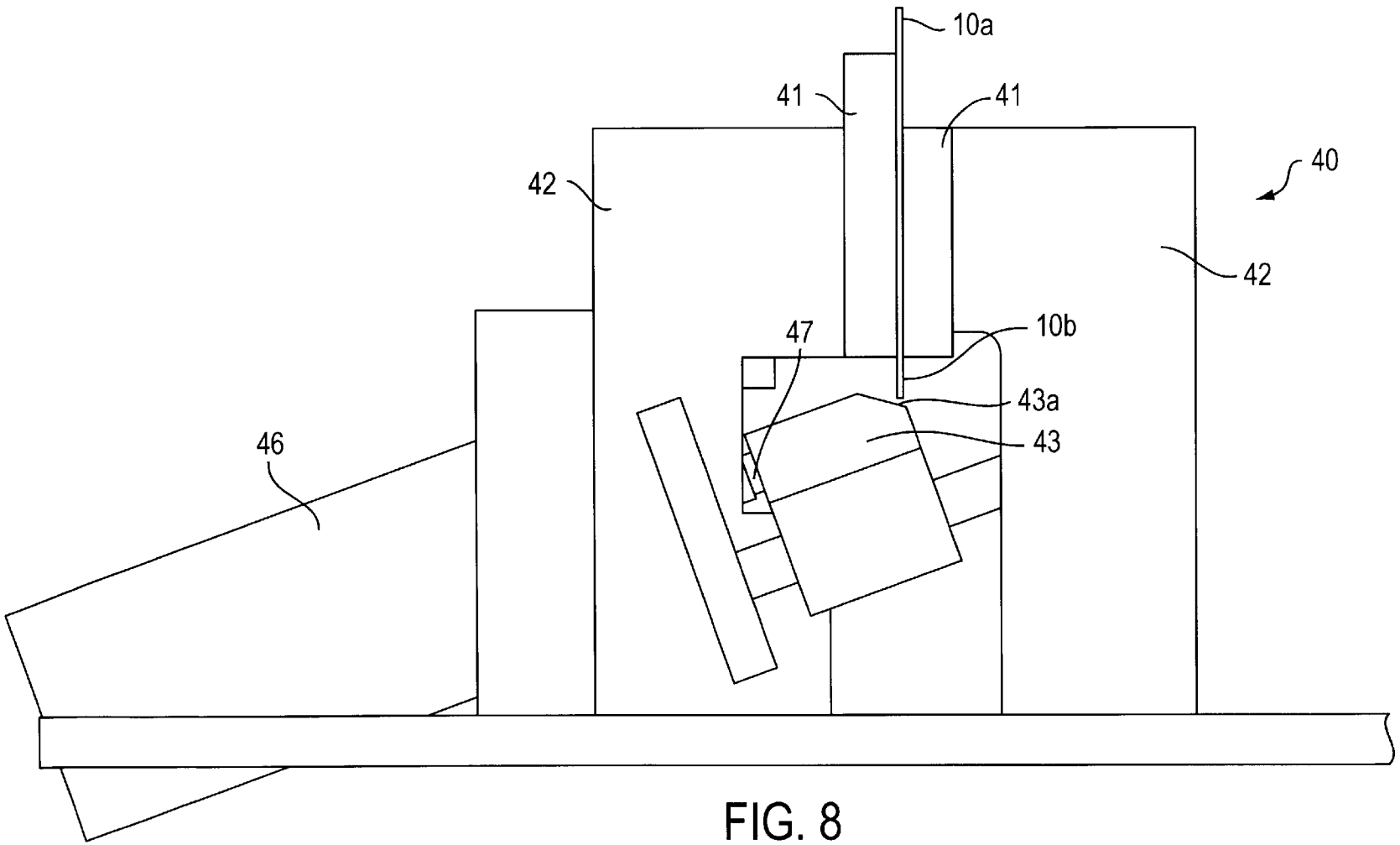
FIG. 8 is a side view of the flange assembly of FIG. 7 in a first position prior to forming a flange.
Figure 9:
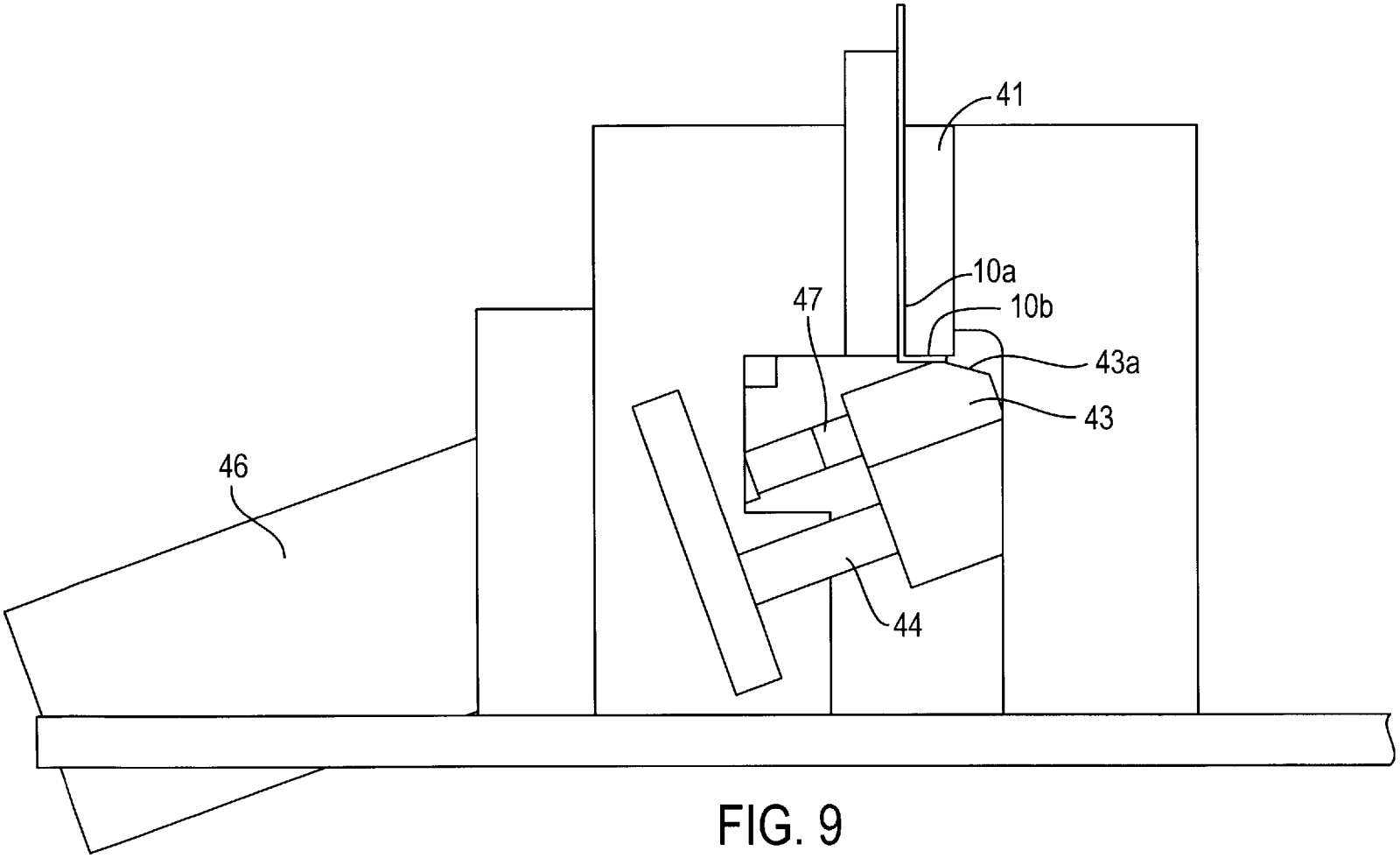
FIG. 9 is a view similar to FIG. 8, but showing the flange forming assembly immediately after having formed a flange.

Referring to FIGS. 7–9, the flange forming assembly 40 has material guides and supports 41 for guiding the strip of material 10*a* along the material feed path 11 and holding a strip of material 10*a* during formation of a flange at 10*b* of the strip of material 10*a*. The material guides and supports 41 are supported by support members 42 on a base or frame of the machine. A sliding bend arm having an engaging surface 43*a* is slidably mounted on the linear bearing rod 44. The linear bearing rods 44 (only one of which is seen in FIG. 7) allow for linear support and movement of the sliding bend arm during formation of the flange. The linear bearing rods 44 are supported by linear bearing rod support members 45, which are in turn supported by the support members 42.

A fluid cylinder or motor 46 is supported by a first support member 48*a*, and the first support member 48*a*is in turn supported by second support members 48*b* for the fluid cylinder or motor. A rod 47 of the fluid cylinder or motor 46 is connected with the sliding bend arm 43.

When the strip of material is to be flanged, the program controls the strip of material to be flanged every twelve inches. Thus, the notches will also be formed every twelve inches in order to allow for the formation of the flange every twelve inches. When the strip of material 10*a* reaches the flange assembly, the computer commands the fluid cylinder or motor 46 to fire and retract. This causes the cylinder rod 47 to extend, thus moving the sliding bend arm along the linear bearing rods 44 and causing the engaging surface 43*a* to engage the lower one-half inch 10*b* of the strip of material 10*a* to bend the material. As can be seen from FIG. 9, at its full extension position, the hydraulic rod 47 has moved the engaging surface 43*a* into a position in which the flange area 10*b* of the material is pressed against the lower surface of the right hand material guide and support 41 (as seen in FIG. 9). After formation of this flange, the strip of material will then be forwarded a further twelve inches to form the next section of flange.

Referring again to FIG. 1, the feed assembly 20*b* is positioned between the flange forming assembly 40 and a cutting assembly 50. The cutting assembly 50 has the purpose of cutting the material at the end of the program for the formation of a particular letter or character or whatever shape is being bent, to cut the material at the end of the program so that the final formed part can be removed from the machine.

Figure 10:
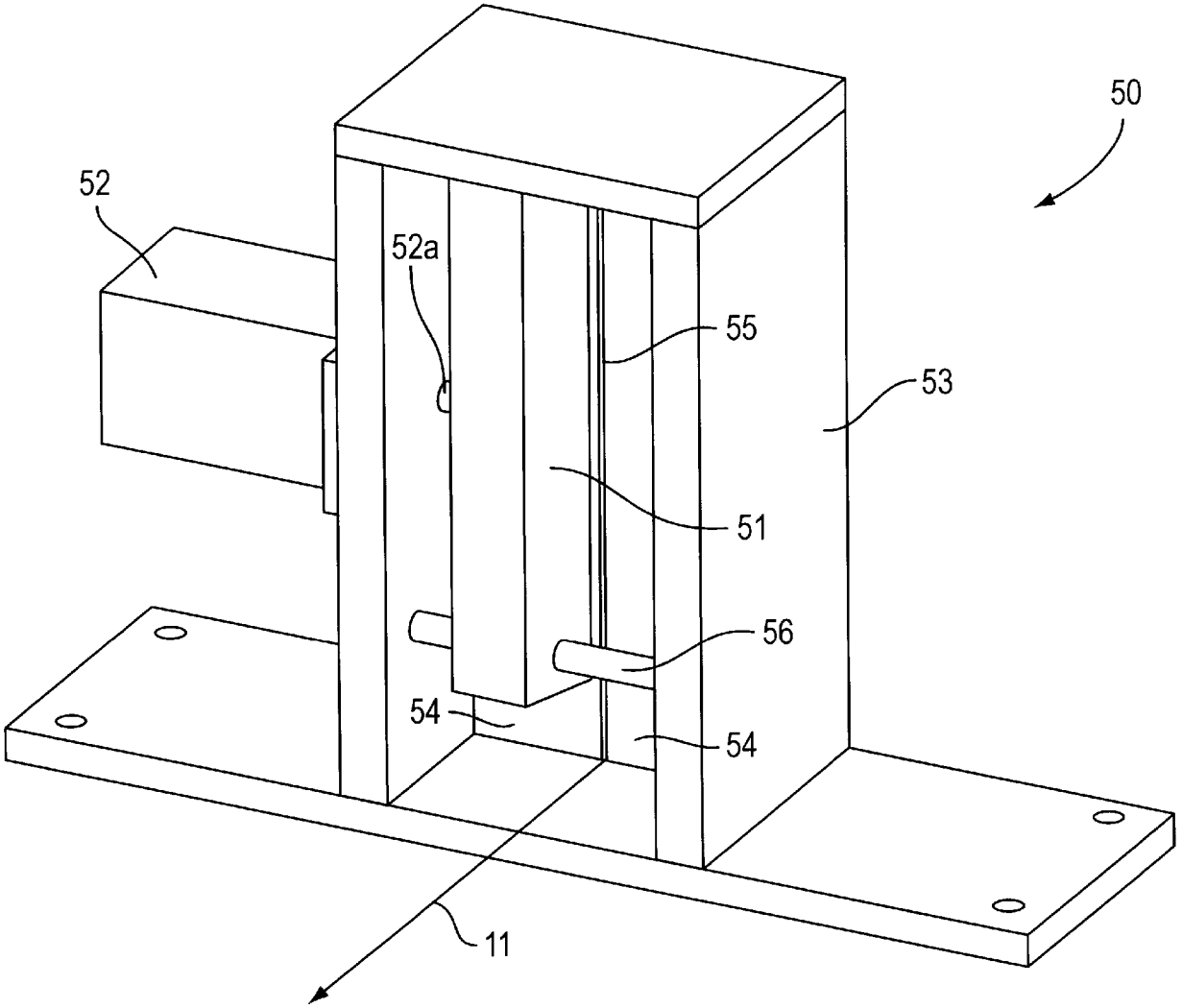
FIG. 10 is a schematic perspective view of a cutting assembly of the machine of FIG. 1.

Referring to FIG. 10, the material feed path 11 extends through a slit 55 of the cutting assembly 50. On the downstream side of the slit 55 is located a cutting knife 51 for cutting the material. A fluid cylinder or motor 52 is mounted on a housing 53 and has a rod 52*a* connected with the cutting knife 51 for movement of the cutting knife 51 in a direction perpendicular to the direction of material advance along the material feed path 11. Material supports 54 define the slit 55 therebetween and provide a support for the material 10*a* during cutting. Linear bearing rods 56 (only one of which is shown in the drawing figure) provide linear guiding and support for the cutting knife 51 during the cutting operation.

When the material 10*a* has been fed to the correct position to be cut, the computer commands the fluid cylinder or motor 52 to fire and retract, causing the strip of material 10*a* to be parted at that point.

Figure 12:
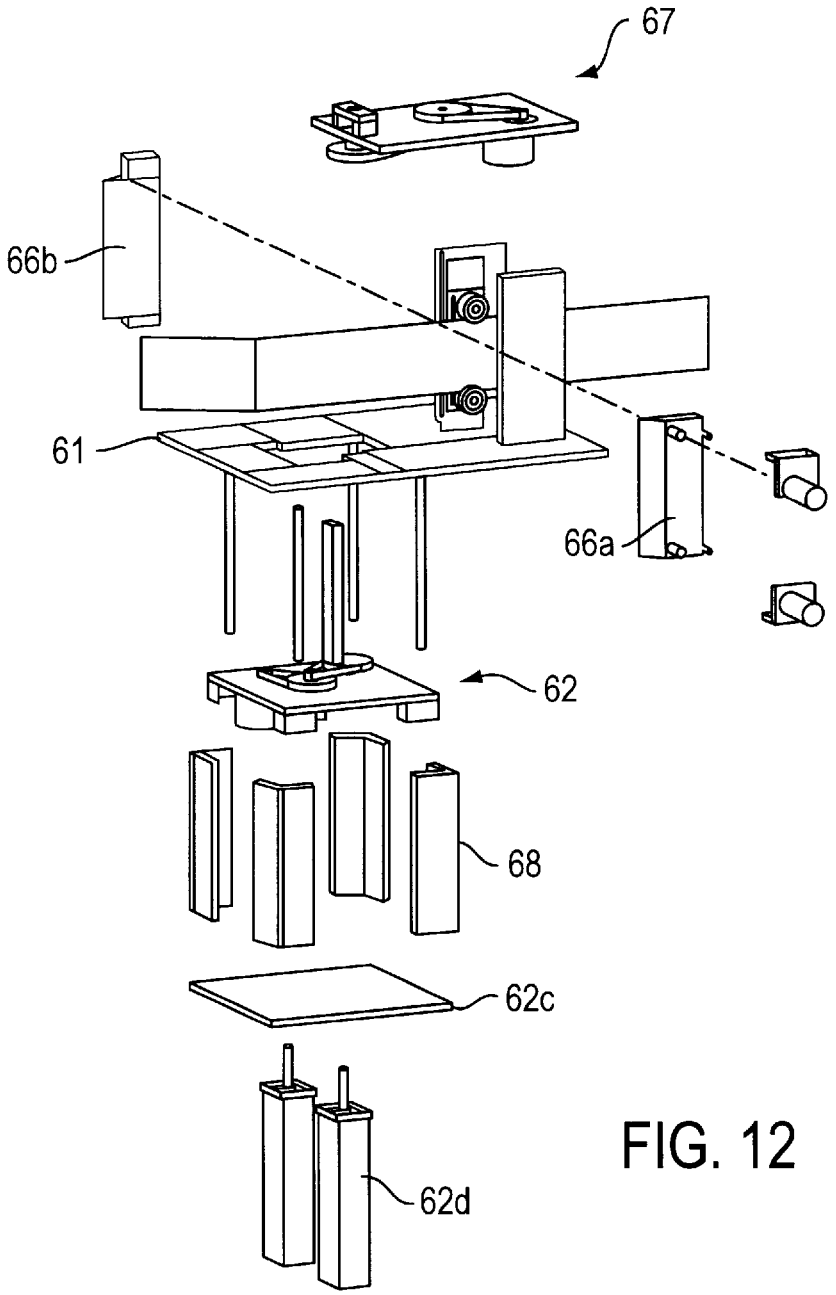
FIG. 12 is an exploded perspective view of the bending assembly of FIG. 11.
Figure 13:
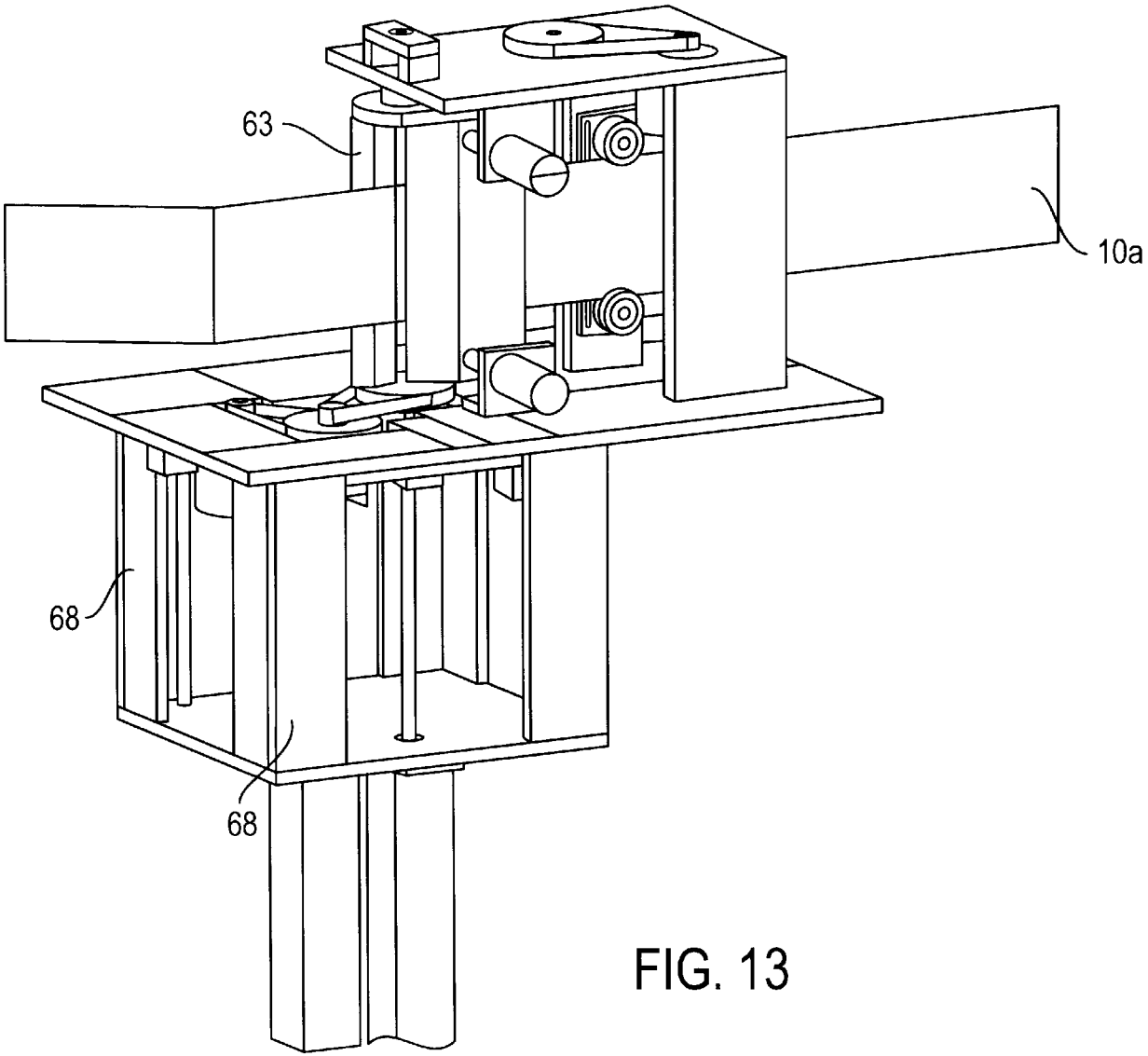
FIG. 13 is a view similar to FIG. 11, but with all parts of the bending assembly in place and a movable platform in an upper position.

A bending assembly 60 is located immediately after the cutting assembly 50. This bending assembly can initially be referenced from FIGS. 11–13. Operation of the bending assembly 60 can be seen from FIGS. 14A–14G.

The bending assembly 60 has a frame or base 61, connected with the overall machine, for supporting the various components thereof. A bottom motor drive assembly 62 is supported at a lower part of the base 61, and a top motor assembly 67 is supported on top of the base 61. These two assemblies combine to drive a bending arm 63 for bending the strip of material 10*a* fed along the material feed path. Guide rollers 65 guide the material into the bending assembly 60 so as to properly position the strip of material between clamps 66.

Clamps 66 sandwich the strip of material 10*a* therebetween. The first clamp 66*a* is movable. Fluid cylinders or motors 66c are provided for moving the clamp 66*a* toward and away from a corresponding fixed clamp 66*b*. In operation, these two clamps support the strip of material 10*a* during bending with the bending arm 63.

The bending arm 63 can bend from either side of the strip of material 10*a*. The bending arm 63 moves from one side of the strip of material 63 through the motion of the bottom motor drive assembly 62.

The bottom motor drive assembly 62 has a movable platform 62*a* that is guided by guide rods 62*b* for movement up toward and down away from the material feed path 11. The guide rods 62*b* are supported on a bottom plate 62*c*. Fluid cylinders or motors 62*d* drive bottom motor drive assembly 62 in upward and downward movement.

Mounted to the movable platform 62*a* is a motor 62*f* having an output shaft engaging with a transmission 62*g*. The transmission 62*g* rotates a rotatable base 62*h* to which the bending arm 63 is fixed. Thus, by rotation and reverse rotation of the motor 62*f*, the bending arm 63 can be moved from one side of the material feed path 11 to the other. By the action of the fluid cylinders or motors 62*d*, the bending arm can be moved upward into position for bending the strip of material 10*a*, or downward for movement to the other side of the strip of material 10*a*.

An upper end of the bending arm 63 is provided with a connection for connecting to a rotatable base 67*e* of the top motor assembly 67. The rotatable base 67*e* has a pin connector 67*f* thereon, and the end of the bending arm 63 has pin receiving holes 64 therein. It should be noted, however, that the pin receiving holes and the pins could be reversed, or a different type of connecting arrangement could be provided.

The rotatable base 67*e* is driven by a transmission 67*d*, generally similar to the transmission 62*g*. The transmission 67*d* is connected with the motor 67*c* mounted on a platform 67*a* of the top motor assembly 67. The platform 67*a* is supported on the base 61 by suitable support members 67*b*.

Bottom plate support members 68 are provided between the base 61 and the bottom plate 62*c*.

Figure 11:
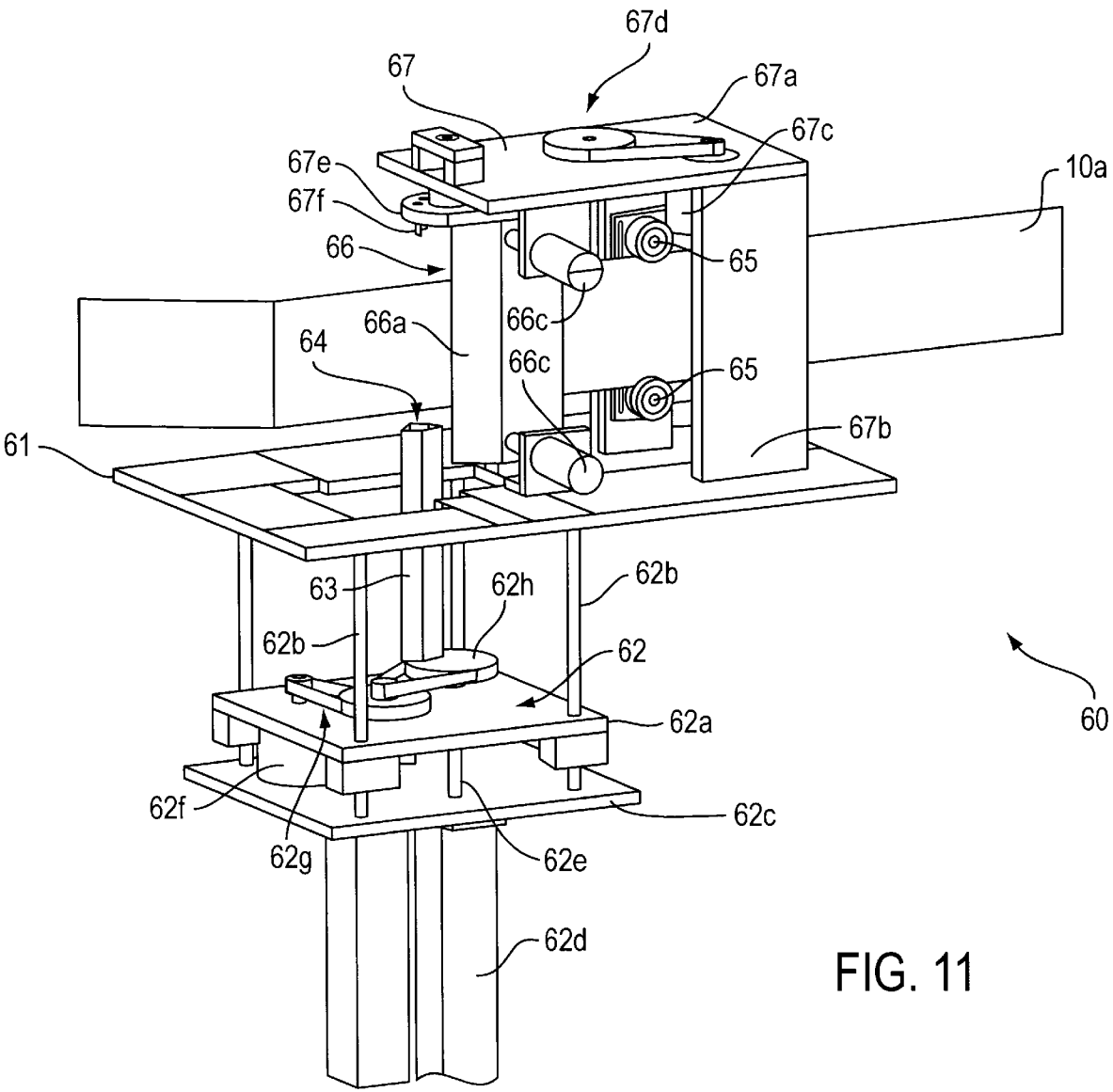
FIG. 11 is a schematic view, with some parts removed, of a bending assembly of the machine of FIG. 1.
Figure 14A:
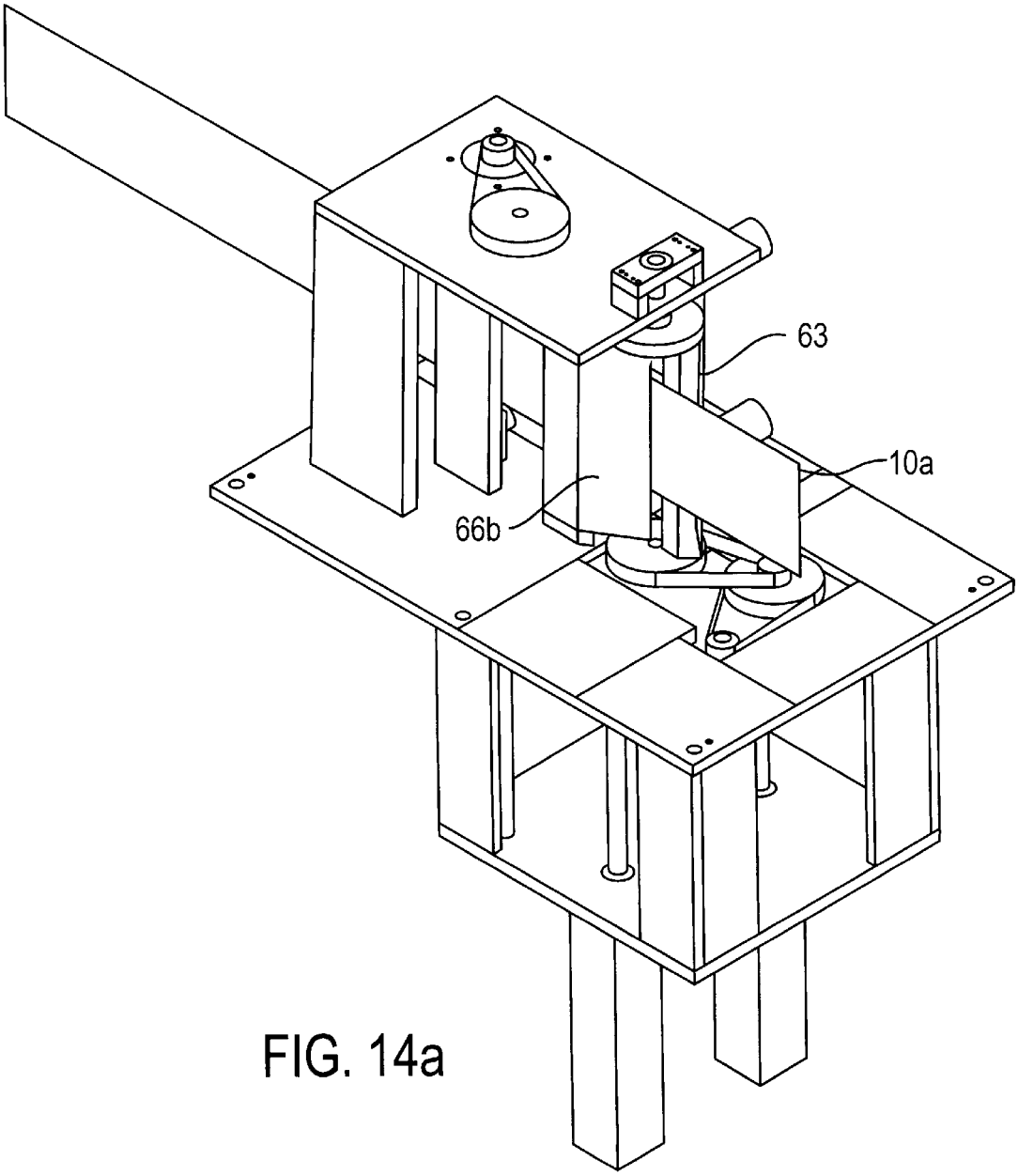
FIGS. 14A–14G are perspective views of the bending assembly of FIG. 11 at different stages during a bending operation.
Figure 14B:
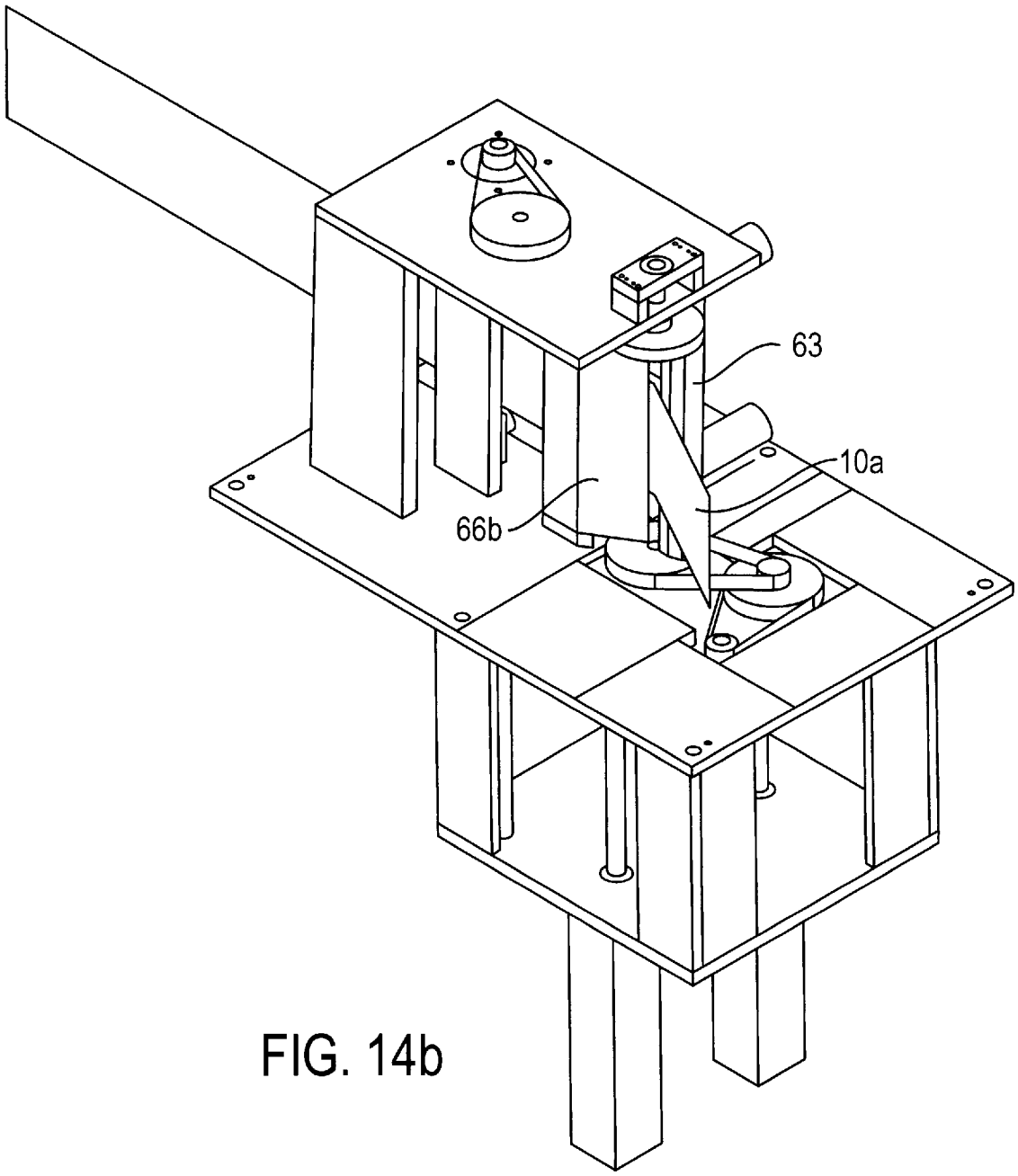
Figure 14C:
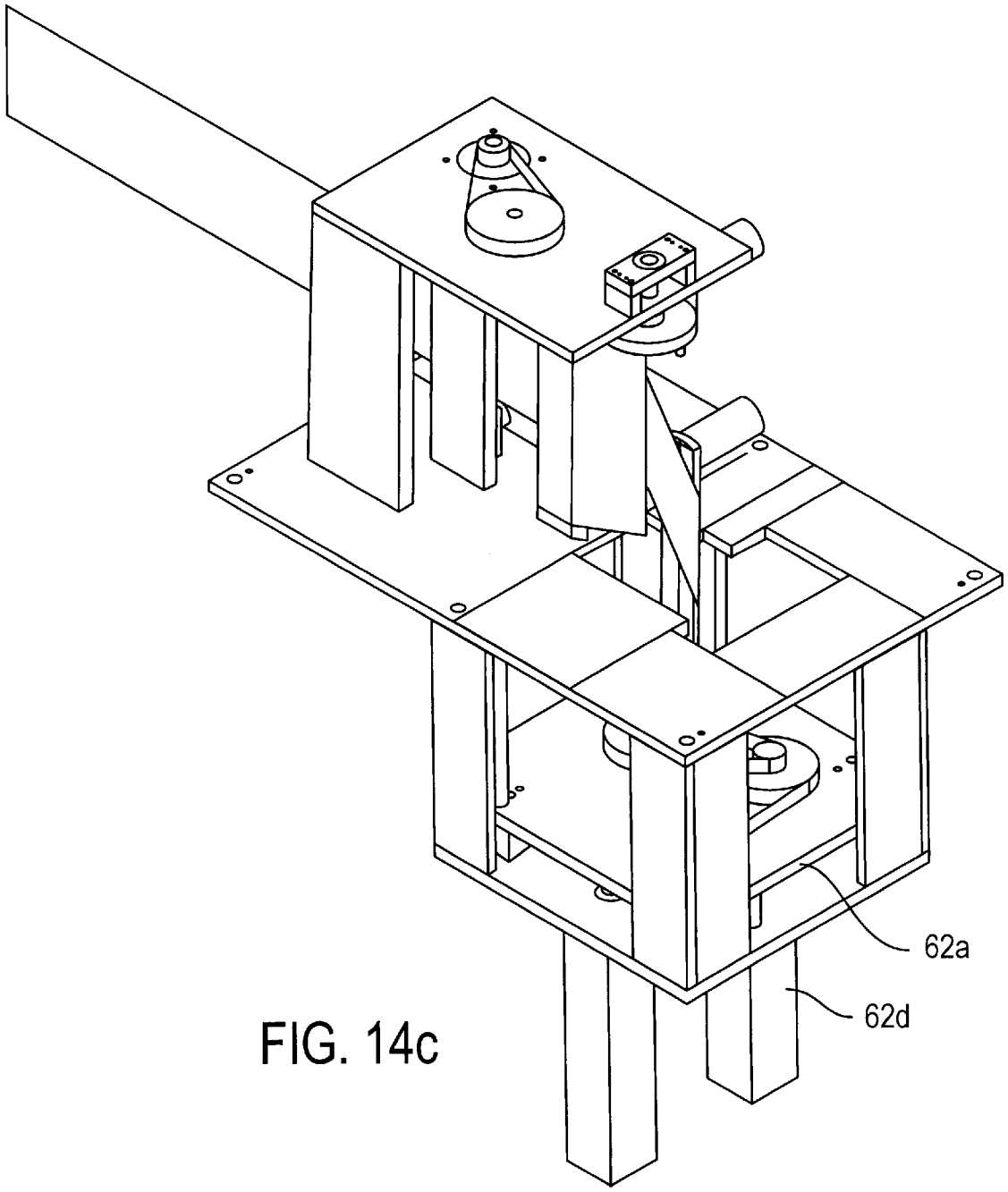
Figure 14D:
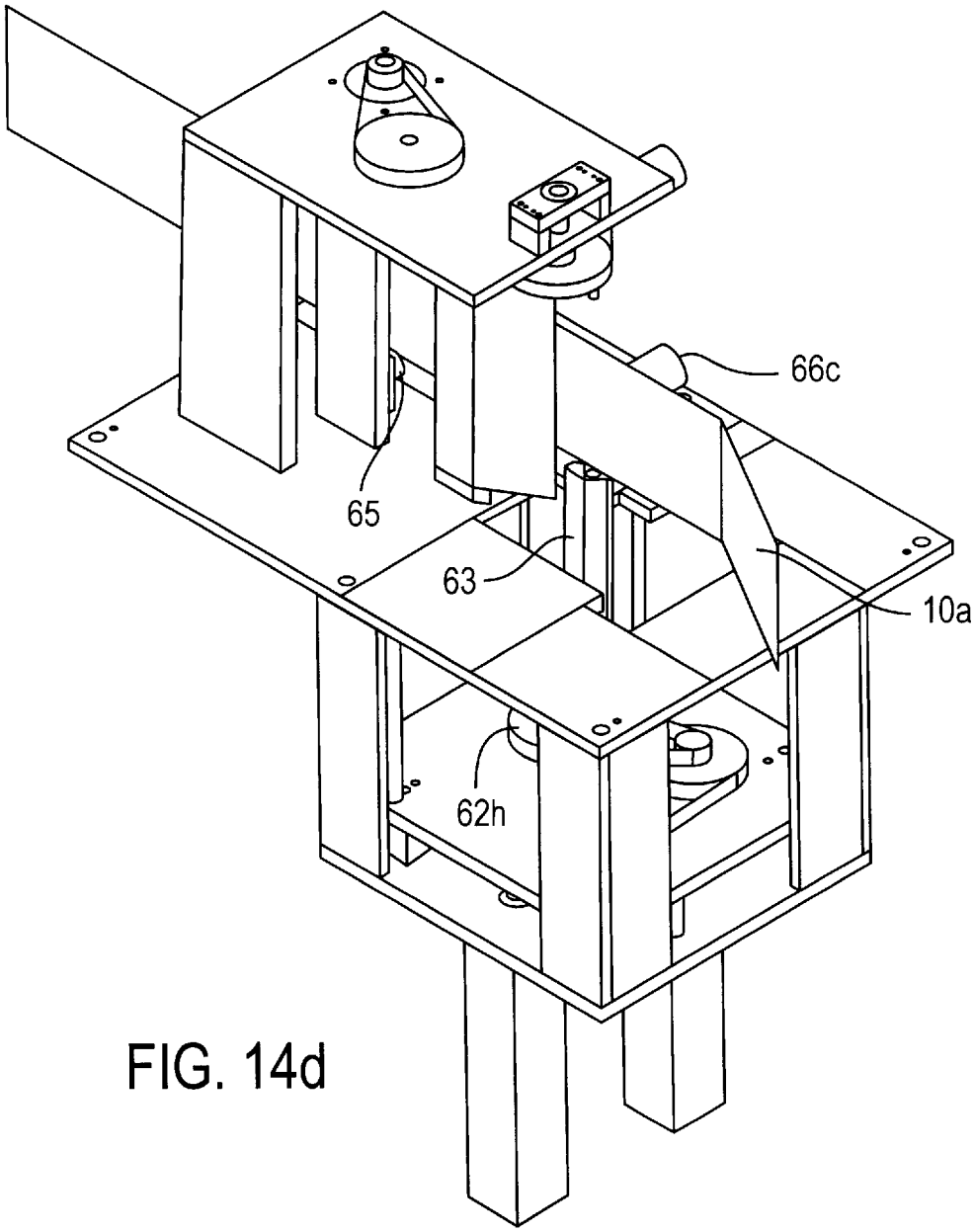

FIG. 14A looks at the bending assembly 60 from a perspective direction opposite to that of FIG. 11. In this figure, the strip of material 10*a* has been advanced to a position at which a first bend will be made in the material. The bending arm 63 at this point is connected to both the upper and lower rotatable bases 67*e* and 62*h*. Turning to FIG. 14B, the bending arm 63 is driven in rotation by both motors 62*f* and 67*c* through the rotatable bases 67*e* and 62*h* to form a bend in the strip of material 10*a*. These motors are synchronously driven so that both rotatable bases will turn the same amount. This ensures an even distribution of bending force across the width of the strip of material 10*a* and a correctly angled bend to be formed in the strip of material. supporting the bending arm 63 at both ends further prevents deflection of the bending arm 63 from its proper bending position.

To form a bend on the other side of the strip of material 10*a*, the bending arm 63 is lowered with the movable platform 62*a* and the fluid cylinders or motors 62*d*. The pin receiving holes 64 are simply disconnected from the pin connector 67*f* to allow the bending arm 63 to move downward. Upon the movable platform 62*a* being sufficiently lowered for the bending arm 63 to clear the bottom edge of the strip of material 10*a*, the bending arm 63 can be moved to the other side of the material feed path 11. Note FIG. 14D. At the same point, the strip of material 10*a* is also advanced to the next bending position.

Figure 14E:
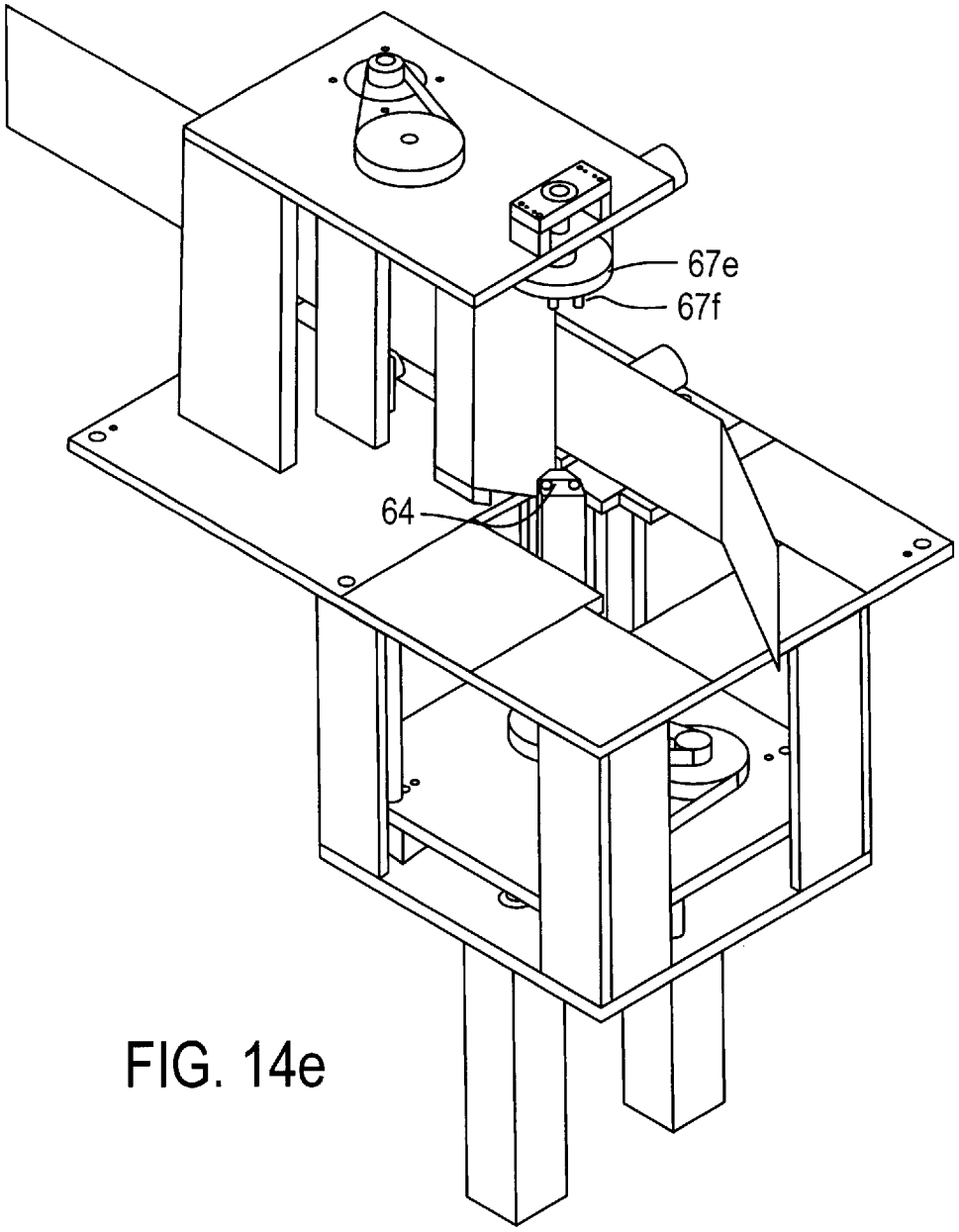
Figure 14F:
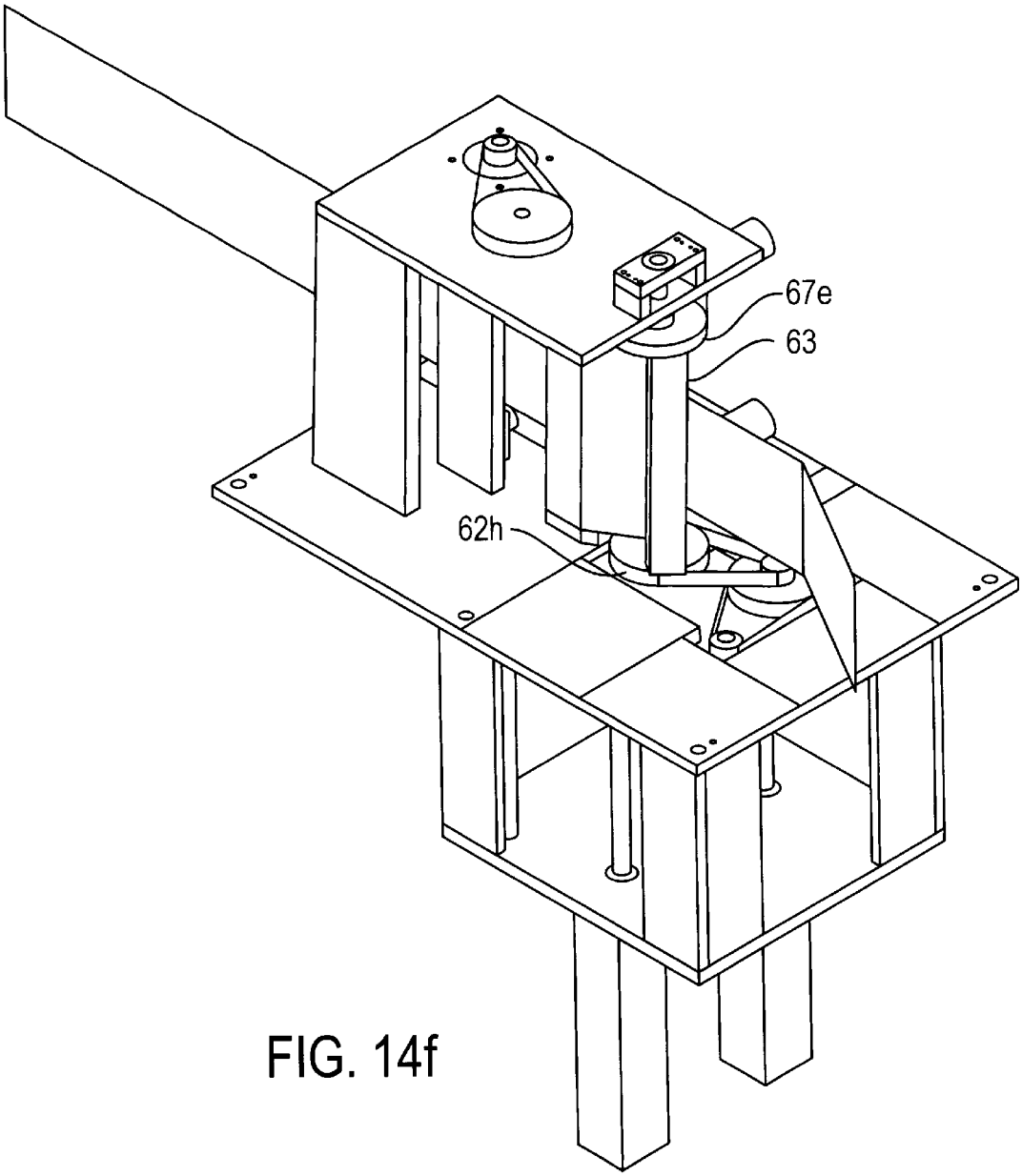

FIG. 14E illustrates the rotation of the bending arm 63 into position for movement upward. Further note FIG. 14F, at which point the bending arm 63 has moved all the way up so that the pin receiving holes 64 engage with the pin connector 67*f* on the rotatable base 67*e*. At this point, the next bend can be carried out.

Figure 14G:
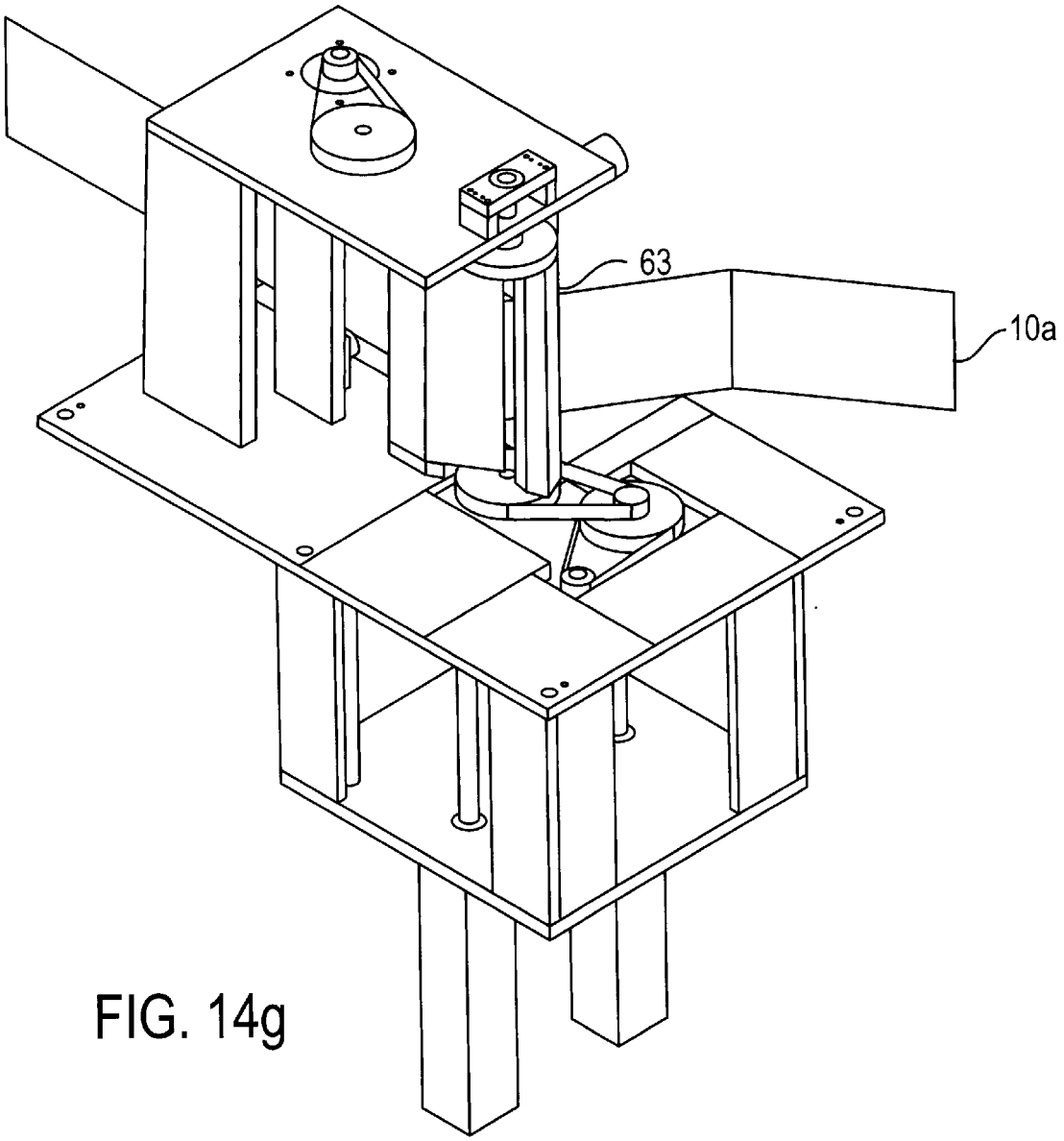

In FIG. 14G, a bend in the opposite direction is illustrated. Thus it can be seen that the strip of material 10*a* can be bent in any desired direction by simply appropriately moving the bending arm 63 to the appropriate side of the strip of material 10*a* after the material is advanced so that the bending position is positioned between the end surfaces of the clamps 66. By continuing in this fashion, any desired shape can be formed.

It should be noted that when the bending arm is moved from one side to the other, both of the rotatable bases are still moved synchronously, even though they are not connected to each other through the bending arm 63. This ensures that the pin receiving holes 64 will be properly aligned with the pin connectors 67*f*.

Obviously, if two subsequent bends are to be made from the same side of the material, it will be unnecessary to move the bending arm 63 to the other side, and will only be necessary to advance the strip of material 10*a* to the appropriate bending position.

The clamps 66 clamp the strip of material 10*a* therebetween during bending. During feed of the strip of material 10*a*, the clamp 66*a* is withdrawn from the strip of material 10*a* to allow for movement of the strip of material 10*a*.

The strip of material 10*a*, as it moves through the machine, can be appropriately supported vertically by rollers or other suitable supports to maintain the strip of material 10*a* in the appropriate position along the feed path 11. Such rollers are suitably located at the feed assemblies 20, 20*a* and 20*b*. Guides can also be placed along the material feed path 11 for guiding the strip of material 10*a*. Such guides might, for example, be of the form of the supports 41 employed with the flange forming assembly 40.

Operation of the present invention is performed under the control of the computer. The computer is appropriately programmed to receive data information concerning the type of shape to be cut, whether that shape corresponds to some character, a specific letter or any other shape which is programmed to be formed. In particular, numerical data is converted by the computer into suitable commands for forming the appropriate shape.

For the machine according to the present embodiment, the end product or channel letter that is being formed will normally have been laid out and represented graphically by using an existing off the shelf software package. Many software packages can be used to layout graphically what a final formed product will look like. These packages are capable of exporting (saving) a file in a format that can then be converted by the software controlling the machine according to the present invention. The format for exported files that are preferred with the present embodiment is DXF, a format developed by AutoCad, but which format is available on many different software packages. However, it may be contemplated that many different conversion formats can be used, like HPGL or G-Code.

Figure 15:
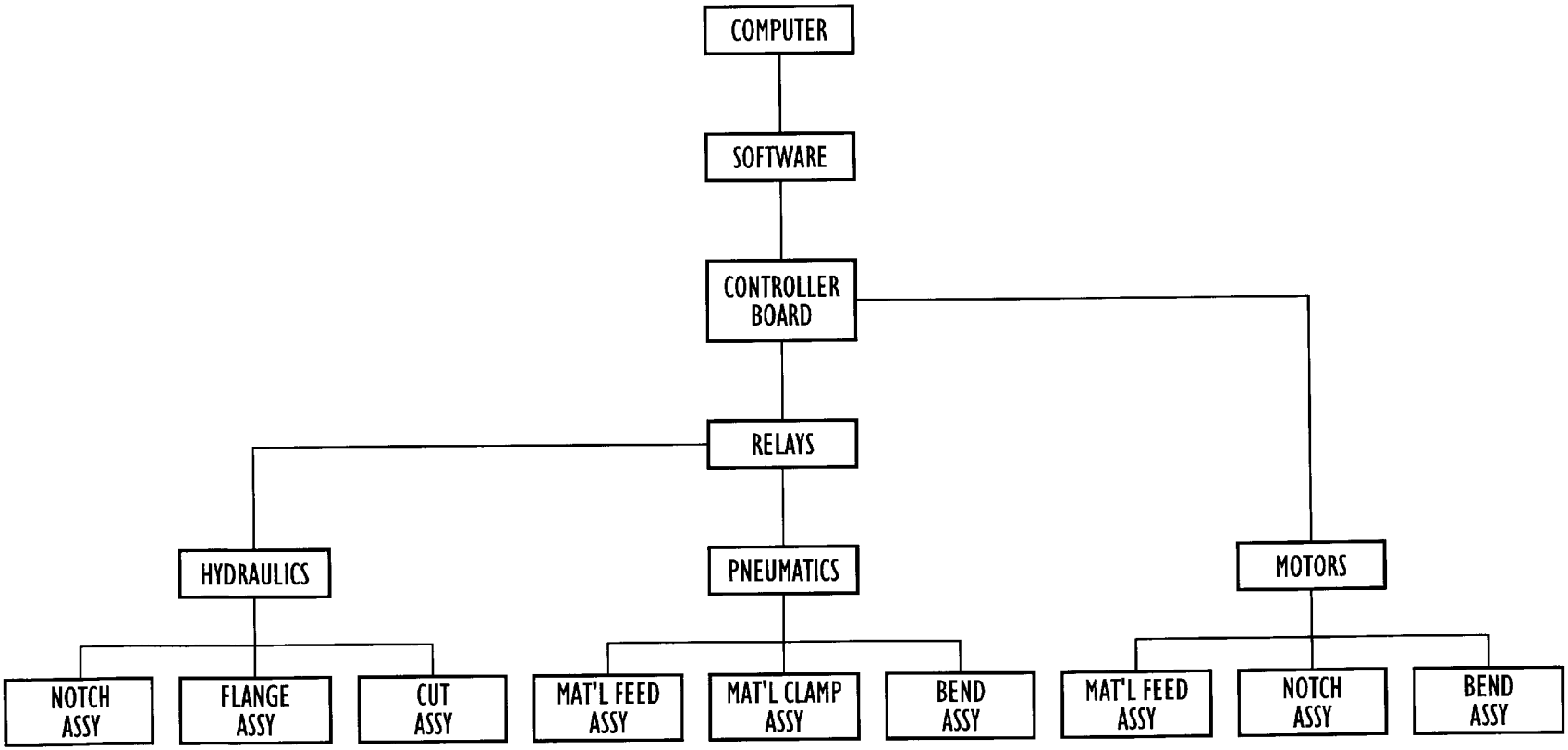
FIG. 15 is a schematic diagram of the components of the machine of FIG. 1 as they interrelate with a computer control system.

An overall system layout is illustrated in FIG. 15. According to this layout, the computer, under the control of its software, and a controller board, operates the various electric motors employed with the systems, and through relays, operates the various pneumatic and hydraulic cylinders.

The software operated by the computer controlling the machine of the present invention reads in the exported file. The software then reads in and stores all detailed information for the lines and arcs describing the product or channel letter. For lines, the information would be: start X and start Y coordinates, and ending X and ending Y coordinates. For arcs, the information would be: center X coordinate, center Y coordinate, radius, start angle, and ending angle.

Once the information is read in and stored, numerous calculations, manipulations and comparisons are performed in order to yield the final information that the machine's control program will utilize. The controller board processes this information in order to control the motors, hydraulic cylinders and pneumatic cylinders of the machine in order to yield the correctly formed end product. The controller compares all of the final information and determines the proper sequencing for controlling the feed rates and linear feed of the material into and throughout the machine. Thus the control software must determine where, what magnitude and in what sequence the machine must perform either a notching operation (for bending or for flanging), a flanging operation (bending of the final one-half inch of the material, if required), the bending operation (what direction of bend, and what angle) and the final cut operation.

Once the final product has been successfully formed, the controller feeds the material backwards through the machine, and reestablishes a starting "home" position for the material. At this point, the machine is then ready for the next part to be formed.

Figure 16:
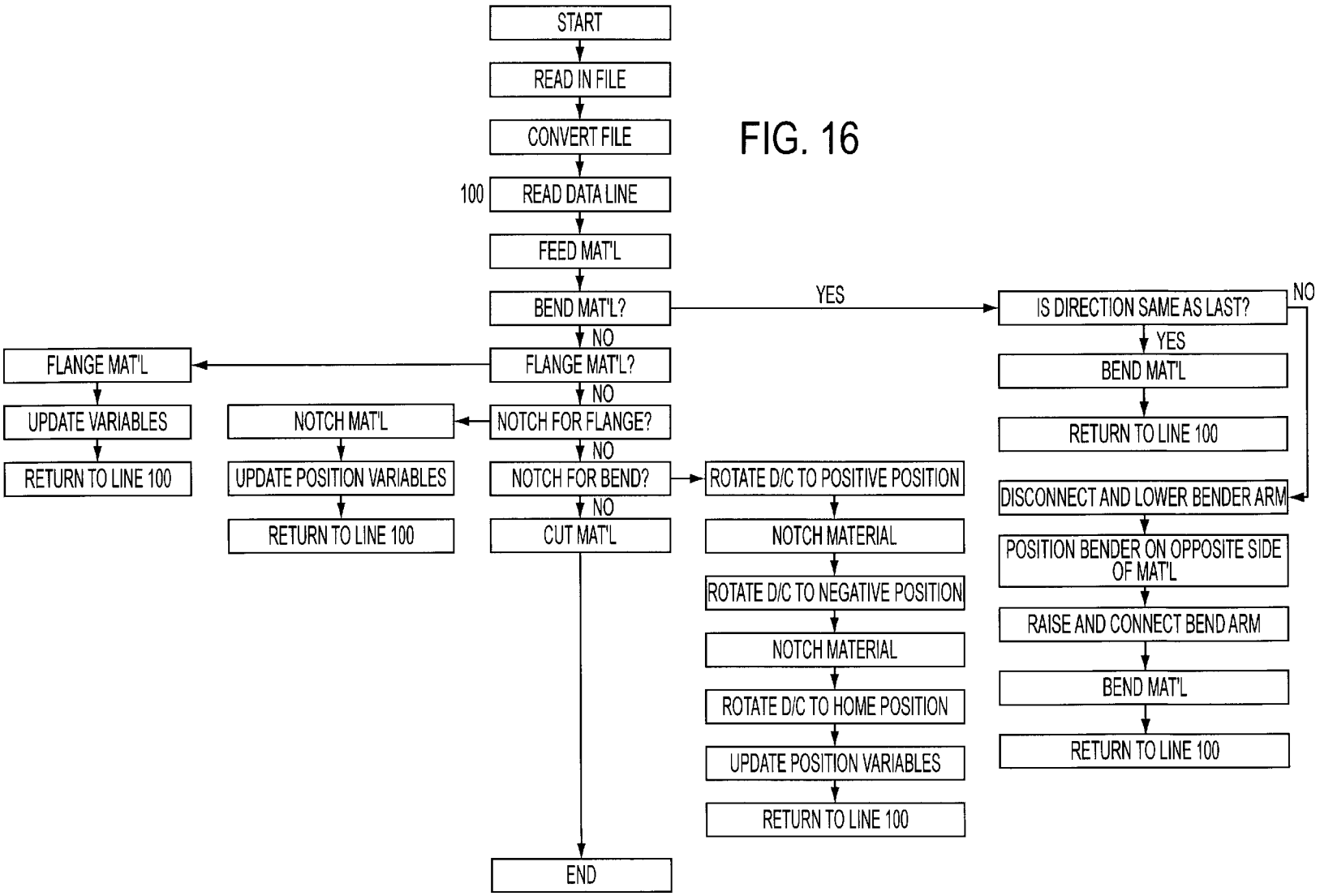
FIG. 16 is a flow chart of the operation of the machine of FIG. 1.

Referring to FIG. 16, the basic flow of operation through the computer is illustrated. First, a data file is read in, and that file is converted to the appropriate information for the formation of the shape, i.e. a number of data lines are prepared. A step 100, each data line is read. According to the data read from that line, material is fed. An inquiry is then made whether the material should be bent. According to the data line, if the answer is no, the next inquiry is whether the material is flanged. If the answer to this is no, the next inquiry is whether the material should be notched for a flange. If the answer is yes, the material is proceeded to be notched, and the various position variables are updated. The program then returns to line 100. If the answer is no, an inquiry proceeds to ask whether the material should be notched for a bend. If the answer is yes, the material is proceeded to be notched as illustrated. After notching is complete, the program returns to line 100. In this way, the program can proceed through the various necessary steps of notching for a flange or for a bend, forming a flange on the material when necessary, and bending the material when appropriate.

Returning to the portion of FIG. 16 inquiring whether or not to bend the material, if the inquiry is answered yes, there is a further inquiry as to whether the direction of the bend is the same as the previous bend. If the answer is yes, the bend is simply made and the program returns to line 100. However, if the answer is no, then the bending arm is moved to the other side for bending.

From the process described with respect to FIG. 16, it can be seen that when the computer program takes over control of the machine, depending upon whether or not the operation calls for the machine to notch the material either once, or twice for an angle larger than 20°, or whether it calls for a flange to be bent at the last bottom one-half inch of the material, or to bend the material to a desired angle, these steps can be carried out within a proper sequential order by the computer program controlling the feed assemblies to linearly move the material to the correct desired location and the notching assembly, the flange forming assembly, the cutting assembly and the bending assembly.

As described above, there is at least one feed assembly positioned in the machine. of course, there can be only one or more than one feed assembly as required. As the material passes through the second feed assembly in the above-described embodiment, it is noted, the material trips a switch, and fires the press rollers on the second feed assembly. For multiple feed assemblies, the feed assemblies would be synchronized with the first feed assembly in that the material is fed at the same speed at all feed station.

The present invention has been described above with respect to the preferred features thereof. However, it should be recognized that various changes and modifications to the above-described embodiment can be made without departing from the scope and spirit of the present invention as defined in the appended claims.

For example, the preferred embodiment of a flange forming assembly has been described above. However, for purposes of the method as well as the overall machine, other types of flange forming assemblies might be considered. For example, a roll forming assembly could be used to form the flange on the strip of material 10*a*. Also, a preferred form of a notching assembly has been described above. However, other types of devices might be considered appropriate for the formation of the notch in the overall machine or in the method according to the present invention. For example, a slicing mechanism might be adapted which, instead of employing a punch and die, made separate cuts in the strip of material 10*a* to form notches.

I claim:

1. A method of automatically bending channel letters from metal material, comprising the steps of:

inputting a desired configuration for a channel letter shape to be formed into a control computer;

feeding the metal material under the control of the control computer along a feed path through a metal material bending machine that includes a notching station, a flanging station, a cutting station and a bending station that are arranged along the feed path for the metal material, with the notching station and the flanging station being located upstream of the bending station along the feed path;

when a flange is desired based on the desired configuration for a channel letter shape for the attachment of a back of the channel letter, a) notching the metal material at lo cations on the metal material corresponding to the position of the flange and positions of bends at the notching station under the control of the control computer, and b) forming the flange on the bottom of the metal material at desired flange positions on the metal material at the flanging station under the control of the control computer;

when a flange is not desired based on the desired configuration for a channel letter shape, feeding the metal material to the bending station without notching and flanging the metal material;

bending the metal material at the positions of the bends into the desired configuration for a channel letter shape at the bending station under the control of the control computer; and cutting the metal material at the cutting station after said bending.

2. The method of claim 1, wherein said notching comprises forming a notch along an edge of the metal material by the computer controlling a punch and die set of the notching station to punch the notch along the edge of the metal material.

3. The method of claim 1, wherein said notching comprises forming a wedge-shaped notch.

4. The method of claim 1, wherein a flange is formed on the metal material at the flange forming station.

5. The method of claim 1, wherein said forming a flange comprises supporting the strip of material and pressing an edge of the strip of material such that it bends to form a ninety degree angle with the remainder of the strip of material.

6. The method of claim 5, and further comprising forming at least two notches on the edge of the strip of material at the notch forming station, and wherein said step of forming a flange further comprises bending the edge of the strip of material between the notches formed at the notch forming station.

7. A method of automatically bending a metal material, comprising the steps of:

inputting a desired configuration for a shape to be formed into a control computer;

feeding a strip of metal material from a supply of the metal material to a notching station;

feeding the strip of material from the notching station to a flange forming station;

bending the strip of material at a bending station into the desired configuration for a shape to be formed with the bending station under the control of the control computer;

cutting the strip of material from the supply of the metal material; and notching the strip of material at the notching station, comprising forming a wedge-shaped notch along an edge of the strip of material by the control computer controlling a punch and die set of the notching station to punch the notch along the edge of the material;

wherein the wedge-shaped notch has a notch angle at least the same as a wedge angle of the punch, and wherein said notching comprises driving the punch toward the die a second time after the punch and die are rotated relative to the strip of material when the notch angle is greater than the wedge angle of the punch.

8. A channel letter bending machine for automatically bending channel letters from metal material to be bent, comprising:

a computer control system for receiving a desired configuration for a channel letter shape to be formed;

a material feeding mechanism controlled by said computer control system disposed along a path of travel of the metal material to be bent;

a notching station disposed along the path of travel for notching the metal material fed by said feeding mechanism along the path of travel;

a flange forming assembly disposed along the path of travel for forming a flange along one edge of the material;

a cutting station disposed downstream of said flange forming assembly and along the path of travel of the material for cutting the material; and a bending station disposed along the path of travel for bending the material under the control of said computer control system into the desired configuration for the channel letter shape, wherein said notching station and said flange forming assembly are disposed upstream of said bending station.

9. The channel bending machine of claim 8, and further comprising a supply of the metal material that comprises a roll of metal material positioned on a table adjacent to said material feeding mechanism.

10. The channel bending mechanism of claim 8, wherein said bending station comprises:

a fixable support positioned adjacent to the path of travel of the strip of material; and a movable bending arm that is movable across the path of travel of the material to bend the material against the fixable support.

11. The channel bending mechanism of claim 10, wherein said movable bending arm is mounted on a rotatable base for movement across he path of travel of the material, said rotatable base being rotatably mounted on a platform that is movable in a direction of the axis of rotation of said rotatable base, whereby said bending arm can move from one side of the material at said bending station to the other side of the material.

12. The channel bending machine of claim 11, wherein said bending arm is fixed at one end thereof to said rotatable base and is removably engaged at an opposite end thereof with a rotatable upper support.

13. The channel letter bending machine of claim 8, wherein said notching station comprises:

a punch located on side of a path of travel of material to be notched and a die located on the other side of the path of travel; and a fluid cylinder or motor connected with said punch for driving said punch toward said die;

wherein said punch and die extend over a predetermined angular range and are rotatably mounted for synchronous rotation.

14. The channel letter bending machine of claim 13, wherein said notching station comprises a motor having an output shaft connected with said die and said punch by pulleys rotatably connected to said die and said punch.

15. The channel letter bending machine of claim 8, wherein said flange forming assembly comprises:

material support members located on opposite sides of a path of travel of material that is to have a flange formed thereon;

a pressing member movably mounted adjacent to said support members, said pressing member having a pressing surface for pressing the material and bending a flange thereon; and a motor connected with said pressing member for moving said pressing member into engagement with the material.

16. The channel letter bending machine of claim 15, wherein said pressing member is mounted on a linear bearing for linear movement toward one end of said support members, and said motor is a fluid cylinder or motor having a rod connected with said pressing member.

17. The channel letter bending machine of claim 15, wherein said support members have a lower surface and said pressing member is mounted below said lower surface for movement toward said lower surface for bending a flange on the material against said lower surface.

18. The channel letter bending machine of claim 8, wherein said bending station comprises:

a frame;

guide rollers mounted on said frame for guiding a material to be bent along a material feed path;

a pair of material holding clamps mounted on said frame and disposed on opposite sides of the material feed path;

a bending arm mounted on a movable base for movement between one position on one side of the material feed path and another position on the opposite side of the material feed path such that said bending arm can bend the material in either direction with respect to the material feed path; and a movable platform having said movable base mounted thereon, said movable platform being movable between a first position in which said bending arm is adjacent to the material feed path and a second position in which said bending arm is remote from the material feed path, whereby said bending arm can be moved between the one and the other position thereof on said movable base when said movable platform is in said second position.

19. The channel letter bending machine of claim 8, wherein said bending station comprises a bending arm having a first end fixed with respect to a first rotatable base and a second end that is removably connected to a second rotatable base.

20. The channel letter bending machine of claim 19, wherein said first and second rotatable bases are connected with respective motors for rotation such that said bending arm can be moved across the path of travel to bend the metal material.

21. The channel letter bending machine of claim 19, wherein said bending arm is removably connected to said second rotatable base by pin connectors on one of said bending arm and said second rotatable base and pin receiving holes on the other of said bending arm and said second rotatable base.

22. A channel letter bending machine for automatically bending channel letters from metal material to be bent, comprising:

a computer control system for receiving a desired configuration input for a channel letter shape to be formed;

a material feeding mechanism controlled by said computer control system disposed along a path of travel of the metal material to be bent;

a cutting station disposed along the path of travel of the material for cutting the metal material; and a bending station disposed along the path of travel for bending the material under the control of said computer control system into the desired configuration for the channel letter shape, aid bending station comprising a bending arm having a first end fixed with respect to a first rotatable base and a second end that is removably connected to a second rotatable base.

23. The channel letter bending machine of claim 22, wherein said first and second rotatable bases are connected with respective motors for rotation such that said bending arm can be moved across the path of travel to bend the metal material.

24. The channel letter bending machine of claim 22, wherein said bending arm is removably connected to said second rotatable base by pin connectors on one of said bending arm and said second rotatable base and pin receiving holes on the other of said bending arm and said second rotatable base.

* * * * *